US006298839B1

(12) United States Patent
Muto et al.

(10) Patent No.: US 6,298,839 B1
(45) Date of Patent: Oct. 9, 2001

(54) AIR-FUEL RATIO CONTROL APPARATUS AND METHOD FOR INTERNAL COMBUSTION ENGINE

(75) Inventors: Harufumi Muto; Makoto Fujita, both of Nishikamo-gun; Naoto Kushi, Okazaki, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/564,283

(22) Filed: May 4, 2000

(30) Foreign Application Priority Data

May 11, 1999 (JP) ..... 11-129792

(51) Int. Cl.[7] ..... F02D 41/14
(52) U.S. Cl. ..... 123/681; 123/672
(58) Field of Search ..... 123/672, 674, 123/681, 683, 684; 701/109

(56) References Cited

U.S. PATENT DOCUMENTS 4,763,264 * 8/1988 Okuno et al. ..... 123/399 X
4,796,591 * 1/1989 Kiyono et al. ..... 123/492
5,628,290 * 5/1997 Iida et al. ..... 123/339.12 X

FOREIGN PATENT DOCUMENTS 4-203446 7/1992 (JP) .

* cited by examiner

*Primary Examiner*—Tony M. Argenbright
(74) *Attorney, Agent, or Firm*—Oliff & Berridge, P.L.C.

(57) ABSTRACT

An air-fuel ratio control apparatus performs an intake air-increasing process based on a region of an air-fuel ratio feedback adjustment coefficient FAF in which the adjustment coefficient decreases the fuel concentration in an air-fuel mixture. The apparatus calculates a fuel injection valve open duration TAU by using a newly calculated air-fuel ratio feedback adjustment coefficient FAFx, instead of using an adjustment coefficient FAF. An air-fuel ratio-increasing feedback adjustment coefficient FVLV in the adjustment coefficient FAFx has a value that cancels an increase in the amount of intake air. Therefore, the fuel injection amount is increased only when the fuel concentration in the mixture is an intake air-increasing process. Hence, torque difference between fuel concentration-increasing and concentration-decreasing control becomes smaller.

15 Claims, 12 Drawing Sheets

AIR FUEL RATIO SENSOR 0.45V

FAF
FAFAV

PFAF

FVLV

FAFx

TAU
t1
t2
t3

AIR FUEL
RATIO SENSOR 0.45V

FAF
FAFAV

PKLAF
0

KLTAFBB
KLTAT

TTA

GA

FVLV
t1
t2
t3

AIR-FUEL RATIO CONTROL APPARATUS AND METHOD FOR INTERNAL COMBUSTION ENGINE

INCORPORATION BY REFERENCE

The disclosure of Japanese Patent Application No. HEI 11-129792 filed on May 11, 1999 including the specification, drawings and abstract is incorporated herein by reference in its entirety.

BACKGROUND OF THE INVENTION

1. Field of the Invention

The present invention relates to an air-fuel ratio control apparatus and method for an internal combustion engine and, more particularly, to an air-fuel ratio control apparatus for an internal combustion engine that detects the air-fuel ratio of an air-fuel mixture supplied into the engine and performs the feedback control of the concentration of fuel in the mixture on the basis of the detected air-fuel ratio so that the air-fuel ratio becomes equal to the theoretical air-fuel ratio.

2. Description of the Related Art

A technology for controlling the air-fuel ratio of air-fuel mixture to the theoretical air-fuel ratio with high precision has been developed in relation to the emission control of an internal combustion engine using a catalyst. In this technology, a sensor, such as an oxygen sensor or the like, that is able to detect a physical quantity that indicates an air-fuel ratio is disposed in an exhaust passage of the internal combustion engine. The technology detects the air-fuel ratio based on components of exhaust gas by using the sensor, and reflects a result of the detection in an air-fuel ratio feedback adjustment coefficient. Based on the air-fuel ratio feedback adjustment coefficient and the amount of intake air, the technology calculates an amount of fuel to be injected. Thus, the amount of fuel supplied corresponding to the amount of intake air is adjusted by using an air-fuel ratio feedback adjustment coefficient so that air-fuel ratio control can be performed with good precision.

For example, if the air-fuel ratio based on components of exhaust gas is on a fuel-lean side of the theoretical air-fuel ratio, the value of the air-fuel ratio feedback adjustment coefficient becomes greater, and the amount of fuel supplied is increased. Therefore, the fuel concentration is adjusted to a higher side so that the air-fuel ratio is brought closer to the theoretical air-fuel ratio. If the air-fuel ratio based on components of exhaust gas is on a fuel-rich side of the theoretical air-fuel ratio, the value of the air-fuel ratio feedback adjustment coefficient becomes smaller, and the amount of fuel supplied is decreased. Therefore, the fuel concentration is adjusted to a lower side so that the air-fuel ratio is brought closer to the theoretical air-fuel ratio. In this manner, the air-fuel ratio is adjusted to the theoretical air-fuel ratio with good precision.

Another technology, disclosed in, for example, Japanese Patent Application Laid-Open No. HEI 4-203446, performs feedback control of the air-fuel ratio by increasing or decreasing the amount of intake air, instead of the air-fuel ratio feedback control that adjusts the amount of fuel supplied. This technology increases or decreases the amount of intake air based on the value of the air-fuel ratio feedback adjustment coefficient, so as to control the air-fuel ratio to the theoretical air-fuel ratio with good precision.

However, the above-described air-fuel ratio feedback control technologies have a problem of fluctuation of torque produced by the internal combustion engine.

In the air-fuel ratio control technology based on the adjustment of the amount of fuel supplied, a state in which the amount of fuel supplied is increased to shift the concentration of fuel in the air-fuel mixture from a low value to a high value, and a state in which the amount of fuel supplied is decreased to shift the concentration of fuel in the air-fuel mixture from a high value to a low value are alternated. The torque produced by the internal combustion engine varies to a relatively great extent between the two states. That is, the torque is smaller when decreasing the amount of fuel supplied than when increasing the amount of fuel supplied. Therefore, fluctuation of the torque produced by the internal combustion engine is caused by the air-fuel ratio feedback control.

In the air-fuel ratio control technology based on the adjustment of the amount of intake air, a state in which the amount of intake air is increased to shift the concentration of fuel in the air-fuel mixture from a high value to a low value, and a state in which the amount of intake air is decreased to shift the concentration of fuel in the mixture from a low value to a high value are alternated in order to bring the air-fuel ratio closer to the theoretical air-fuel ratio. In this case, too, the torque produced by the internal combustion engine decreases during the state of decreasing the amount of intake air. The torque difference between the two states is relatively great. Therefore, fluctuation of the torque produced by the internal combustion engine is caused by the air-fuel ratio feedback control, as in the technology based on the adjustment of the amount of fuel supplied.

Therefore, in either one of the air-fuel ratio feedback control technologies, the drivability becomes insufficient in some cases.

SUMMARY OF THE INVENTION

Accordingly, it is an object of the invention to provide an air-fuel ratio control apparatus for an internal combustion engine that improves drivability by reducing the torque fluctuation caused by the air-fuel ratio feedback control in the internal combustion engine.

To achieve the above and other objects of the invention, an air-fuel ratio control apparatus for an internal combustion engine in accordance with a first aspect of the invention includes a detector that detects an air-fuel ratio of an air-fuel mixture supplied to the internal combustion engine, and a control system that controls a fuel concentration in the air-fuel mixture.

The control system increases the fuel concentration in the air-fuel mixture by a process of increasing an amount of fuel supplied, when the air-fuel ratio detected by the detector indicates a lower fuel concentration than a target air-fuel ratio. The control system decreases the fuel concentration in the air-fuel mixture by a process of increasing the amount of intake air, when the air-fuel ratio detected by the detector indicates a higher fuel concentration than the target air-fuel ratio.

Thus, the fuel concentration in the air-fuel mixture is increased by the fuel-increasing process, and is decreased by the intake air-increasing process. That is, the increasing and the decreasing of the fuel concentration in the air-fuel mixture are both performed by the processes of increasing physical quantities, although the processes use different physical quantities (the quantity of fuel and the quantity of intake air).

Therefore, the difference between the torque produced during the fuel concentration-increasing control (that is, the air-fuel ratio-decreasing control) and the torque produced during the fuel concentration-decreasing control (that is, the air-fuel ratio-increasing control) becomes smaller. Hence, the torque fluctuation caused by the air-fuel ratio control of the internal combustion engine can be reduced, and the drivability can be improved.

An air-fuel ratio control apparatus for an internal combustion engine in accordance with a second aspect of the invention includes a detector that detects an air-fuel ratio of an air-fuel mixture supplied to the internal combustion engine, and a control system that controls a fuel concentration in the air-fuel mixture.

The control system increases the fuel concentration in the air-fuel mixture by a process of decreasing an amount of intake air, when the air-fuel ratio detected by the detector indicates a lower fuel concentration than a target air-fuel ratio. The control system decreases the fuel concentration in the air-fuel mixture by a process of decreasing the amount of fuel supplied, when the air-fuel ratio detected by the detector indicates a higher fuel concentration than the target air-fuel ratio.

Thus, the fuel concentration in the air-fuel mixture is increased by the intake air-decreasing process, and is decreased by the fuel-decreasing process. That is, the increasing and the decreasing of the fuel concentration in the air-fuel mixture are both performed by the processes of decreasing physical quantities although the processes use different physical quantities (the quantity of intake air and the quantity of fuel).

Therefore, the difference between the torque produced during the fuel concentration-increasing control (that is, the air-fuel ratio-decreasing control) and the torque produced during the fuel concentration-decreasing control (that is, the air-fuel ratio-increasing control) becomes smaller. Hence, the torque fluctuation caused by the air-fuel ratio control of the internal combustion engine can be reduced, and the drivability can be improved.

An air-fuel ratio control apparatus for an internal combustion engine in accordance with a third aspect of the invention includes an air-fuel ratio detector that detects an air-fuel ratio of an air-fuel mixture supplied to the internal combustion engine, an intake air amount detector that detects an amount of intake air taken into the internal combustion engine, an intake air amount adjustor that adjusts the amount of intake air taken into the internal combustion engine, and a control system that controls a fuel concentration in the air-fuel mixture.

More specifically, the control system determines an air-fuel ratio feedback adjustment coefficient that is reflected in a fuel concentration in the air-fuel mixture, based on the air-fuel ratio detected by the air-fuel ratio detector. The control system also performs an intake air-increasing process by using the intake air amount adjustor, based on an air-fuel ratio feedback adjustment coefficient that is in such a range as to decrease the fuel concentration in the air-fuel mixture. Based on an increased amount of intake air, the control system determines an air-fuel ratio-increasing feedback adjustment coefficient that cancels an amount of fuel corresponding to the increased amount of intake air. Furthermore, the control system extracts, as an air-fuel ratio-decreasing feedback adjustment coefficient, an air-fuel ratio feedback adjustment coefficient that is in such a range as to increase the fuel concentration in the air-fuel mixture. Still further, the control system adjusts an amount of fuel supplied to the internal combustion engine, based on the air-fuel ratio-increasing feedback adjustment coefficient, the air-fuel ratio-decreasing feedback adjustment coefficient, and the amount of intake air detected by the intake air amount detector.

In this air-fuel ratio control apparatus, when the air-fuel ratio feedback adjustment coefficient is in such a range as to decrease the fuel concentration in the air-fuel mixture, the control system performs the intake air-increasing process based on the air-fuel ratio feedback adjustment coefficient.

With regard to the supply of fuel, the control system adjusts the amount of fuel supplied to the internal combustion engine, based on the air-fuel ratio-increasing feedback adjustment coefficient, the air-fuel ratio-decreasing feedback adjustment coefficient, and the amount of intake air.

The air-fuel ratio-decreasing feedback adjustment coefficient used by the control system is an air-fuel ratio feedback adjustment coefficient of the calculated air-fuel ratio feedback adjustment coefficient that is in such a range as to increase the fuel concentration in the air-fuel mixture. Therefore, when the fuel concentration is to be increased, the air-fuel ratio can be feedback-controlled by increasing the amount of fuel supplied based on the air-fuel ratio feedback adjustment coefficient and the amount of intake air.

The air-fuel ratio-increasing feedback adjustment coefficient is determined based on the amount of intake air increased by the control system such that the air-fuel ratio-increasing feedback adjustment coefficient cancels the amount of fuel corresponding to the increased amount of intake air. Therefore, while the control system is performing the intake air-increasing process based on the air-fuel ratio feedback adjustment coefficient, the amount of fuel supplied to the internal combustion engine is not affected by increases in the amount of intake air, and therefore is not substantially adjusted by the air-fuel ratio feedback control. Hence, when the fuel concentration is to be decreased, the feedback control of the air-fuel ratio can be performed without causing an increase in the amount of fuel because the control system performs the intake air-increasing process based on the air-fuel ratio feedback adjustment coefficient.

Thus, the fuel concentration in the air-fuel mixture is increased by the fuel-increasing process, and is decreased by the intake air-increasing process. That is, the increasing and the decreasing of the fuel concentration in the air-fuel mixture are both performed by the processes of increasing physical quantities, although the processes use different physical quantities (the quantity of fuel and the quantity of intake air) as in the first aspect of the invention.

Besides the advantages similar to those of the first aspect of the invention, the third aspect of the invention is able to realize an air-fuel ratio control apparatus similar to that of the first aspect by using process contents of an air-fuel ratio feedback system that are based on the air-fuel ratio feedback control that use the increasing and decreasing of the amount of fuel supplied while minimizing the changes needed in programs. Thus, the costs needed for changes in programs can be minimized.

An air-fuel ratio control apparatus for an internal combustion engine in accordance with a fourth aspect of the invention includes an air-fuel ratio detector that detects an air-fuel ratio of an air-fuel mixture supplied to the internal combustion engine, an intake air amount detector that detects an amount of intake air taken into the internal combustion engine, an intake air amount adjustor that adjusts the amount of intake air taken into the internal combustion engine, and a control system that controls a fuel concentration in the air-fuel mixture.

More specifically, the control system determines an air-fuel ratio feedback adjustment coefficient that is reflected in a fuel concentration in the air-fuel mixture, based on the air-fuel ratio detected by the air-fuel ratio detector. The control system performs an intake air-decreasing process by using the intake air amount adjustor, based on an air-fuel ratio feedback adjustment coefficient that is in such a range as to increase the fuel concentration in the air-fuel mixture. Based on a decreased amount of intake air, determines an air-fuel ratio-decreasing feedback adjustment coefficient that cancels an amount of fuel corresponding to the decreased amount of intake air. Furthermore, the control system extracts, as an air-fuel ratio-increasing feedback adjustment coefficient, an air-fuel ratio feedback adjustment coefficient that is in such a range as to decrease the fuel concentration in the air-fuel mixture. Still further, the control system adjusts an amount of fuel supplied to the internal combustion engine, based on the air-fuel ratio-decreasing feedback adjustment coefficient, the air-fuel ratio-increasing feedback adjustment coefficient, and the amount of intake air detected by the intake air amount detector.

In this air-fuel ratio control apparatus, when the air-fuel ratio feedback adjustment coefficient is in such a range as to increase the fuel concentration in the air-fuel mixture, the control system performs the intake air-decreasing process based on the air-fuel ratio feedback adjustment coefficient.

With regard to the supply of fuel, the control system adjusts the amount of fuel supplied to the internal combustion engine, based on the air-fuel ratio-increasing feedback adjustment coefficient, the air-fuel ratio-decreasing feedback adjustment coefficient, and the amount of intake air.

The air-fuel ratio-increasing feedback adjustment coefficient used by the control system is a certain adjustment coefficient of the aforementioned air-fuel ratio feedback adjustment coefficient, that is, an air-fuel ratio feedback adjustment coefficient that is in such a range as to decrease the fuel concentration in the air-fuel mixture. Therefore, when the fuel concentration is to be decreased, the air-fuel ratio can be feedback-controlled by decreasing the amount of fuel supplied based on the air-fuel ratio feedback adjustment coefficient and the amount of intake air.

The air-fuel ratio-decreasing feedback adjustment coefficient is determined based on the amount of intake air decreased by the control system such that the air-fuel ratio-decreasing feedback adjustment coefficient cancels the amount of fuel corresponding to the decreased amount of intake air. Therefore, while the control system is performing the intake air-decreasing process based on the air-fuel ratio feedback adjustment coefficient, the amount of supplied fuel set by the control system is not affected by decreases in the amount of intake air to the internal combustion engine, and therefore is not substantially adjusted by the air-fuel ratio feedback control. Hence, when the fuel concentration is to be increased, the feedback control of the air-fuel ratio can be performed without causing a decrease in the amount of fuel because the control system performs the intake air-decreasing process based on the air-fuel ratio feedback adjustment coefficient.

Thus, the fuel concentration in the air-fuel mixture is decreased by the fuel-decreasing process, and is increased by the intake air-decreasing process. That is, the increasing and the decreasing of the fuel concentration in the air-fuel mixture are both performed by the processes of decreasing physical quantities although the processes use different physical quantities (the quantity of fuel and the quantity of intake air) as in the second aspect of the invention.

Besides the advantages similar to those of the second aspect of the invention, the fourth aspect of the invention is able to realize an air-fuel ratio control apparatus similar to that of the second aspect by using process contents of an air-fuel ratio feedback system that are based on the air-fuel ratio feedback control that uses increasing and decreasing of the amount of fuel supplied while minimizing the changes needed in programs. Thus, the costs needed for changes in programs can be minimized.

An air-fuel ratio control apparatus for an internal combustion engine in accordance with a fifth aspect of the invention includes an air-fuel ratio detector that detects an air-fuel ratio of an air-fuel mixture supplied to the internal combustion engine, an intake air amount detector that detects an amount of intake air taken into the internal combustion engine, and a control system that controls a fuel concentration in the air-fuel mixture.

More specifically, the control system determines an air-fuel ratio feedback adjustment coefficient, based on the air-fuel ratio detected by the air-fuel ratio detector. The control system also determines an amount of fuel supplied to the internal combustion engine, based on the amount of intake air detected by the intake air amount detector and the air-fuel ratio feedback adjustment coefficient, when the air-fuel ratio feedback adjustment coefficient is in such a range as to increase the fuel concentration in the air-fuel mixture. Furthermore, when the air-fuel ratio feedback adjustment coefficient is in such a range as to decrease the fuel concentration in the air-fuel mixture, the control system performs an intake air-increasing process, based on the air-fuel ratio feedback adjustment coefficient, and determines the amount of fuel supplied to the internal combustion engine, based on the amount of intake air detected by the intake air amount detector and an air-fuel ratio-increasing feedback adjustment coefficient set so as to decrease in accordance with an increase in the amount of intake air.

In this air-fuel ratio control apparatus, the control determines an amount of fuel supplied to the internal combustion engine, based on the air-fuel ratio feedback adjustment coefficient and the amount of intake air, when the air-fuel ratio feedback adjustment coefficient is in such a range as to increase the fuel concentration in the air-fuel mixture.

When the air-fuel ratio feedback adjustment coefficient is in such a range as to decrease the fuel concentration in the air-fuel mixture, the control system performs the intake air-increasing process based on the air-fuel ratio feedback adjustment coefficient. Furthermore, the control system determines an amount of fuel supplied to the internal combustion engine, based on the amount of intake air and the air-fuel ratio-increasing feedback adjustment coefficient set so as to decrease in accordance with an increase in the amount of intake air.

Therefore, when the air-fuel ratio feedback adjustment coefficient is in such a range as to decrease the fuel concentration in the air-fuel mixture, the air-fuel ratio can be adjusted toward a target air-fuel ratio by increasing the amount of intake air without changing the amount of fuel.

Thus, the fifth aspect of the invention achieves advantages similar to those of the first aspect. Furthermore, the fifth aspect of the invention is able to realize an air-fuel ratio control apparatus similar to that of the first aspect by using process contents of an air-fuel ratio feedback system that are based on the air-fuel ratio feedback control that uses increasing and decreasing of the amount of fuel supplied while minimizing the changes needed in programs. Thus, the costs needed for changes in programs can be minimized.

An air-fuel ratio control apparatus for an internal combustion engine in accordance with a sixth aspect of the invention includes an air-fuel ratio detector that detects an air-fuel ratio of an air-fuel mixture supplied to the internal combustion engine, an intake air amount detector that detects an amount of intake air taken into the internal combustion engine, and a control system that controls a fuel concentration in the air-fuel mixture.

More specifically, the control system determines an air-fuel ratio feedback adjustment coefficient, based on the air-fuel ratio detected by the air-fuel ratio detector. The control system also determines an amount of fuel supplied to the internal combustion engine, based on the amount of intake air detected by the intake air amount detector and the air-fuel ratio feedback adjustment coefficient, when the air-fuel ratio feedback adjustment coefficient is in such a range as to decrease a fuel concentration in the air-fuel mixture. When the air-fuel ratio feedback adjustment coefficient is in such a range as to increase the fuel concentration in the air-fuel mixture, the control system performs an intake air-decreasing process, based on the air-fuel ratio feedback adjustment coefficient, and determines the amount of fuel supplied to the internal combustion engine, based on the amount of intake air detected by the intake air amount detector and an air-fuel ratio-decreasing feedback adjustment coefficient set so as to increase in accordance with a decrease in the amount of intake air.

In this air-fuel ratio control apparatus, the control determines an amount of fuel supplied to the internal combustion engine, based on the air-fuel ratio feedback adjustment coefficient and the amount of intake air, when the air-fuel ratio feedback adjustment coefficient is in such a range as to decrease the fuel concentration in the air-fuel mixture.

When the air-fuel ratio feedback adjustment coefficient is in such a range as to increase the fuel concentration in the air-fuel mixture, the control system performs the intake air-decreasing process based on the air-fuel ratio feedback adjustment coefficient. Furthermore, the control system determines an amount of fuel supplied to the internal combustion engine, based on the amount of intake air and the air-fuel ratio-decreasing feedback adjustment coefficient set so as to increase in accordance with a decrease in the amount of intake air.

Therefore, when the air-fuel ratio feedback adjustment coefficient is in such a range as to increase the fuel concentration in the air-fuel mixture, the air-fuel ratio can be adjusted toward a target air-fuel ratio by decreasing the amount of intake air without changing the amount of fuel.

Thus, the sixth aspect of the invention achieves advantages similar to those of the second aspect. Furthermore, the sixth aspect of the invention is able to realize an air-fuel ratio control apparatus similar to that of the second aspect by using process contents of an air-fuel ratio feedback system that are based on the air-fuel ratio feedback control that uses increasing and decreasing of the amount of fuel supplied while minimizing the changes needed in programs. Thus, the costs needed for changes in programs can be minimized

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENT

Figure 1:
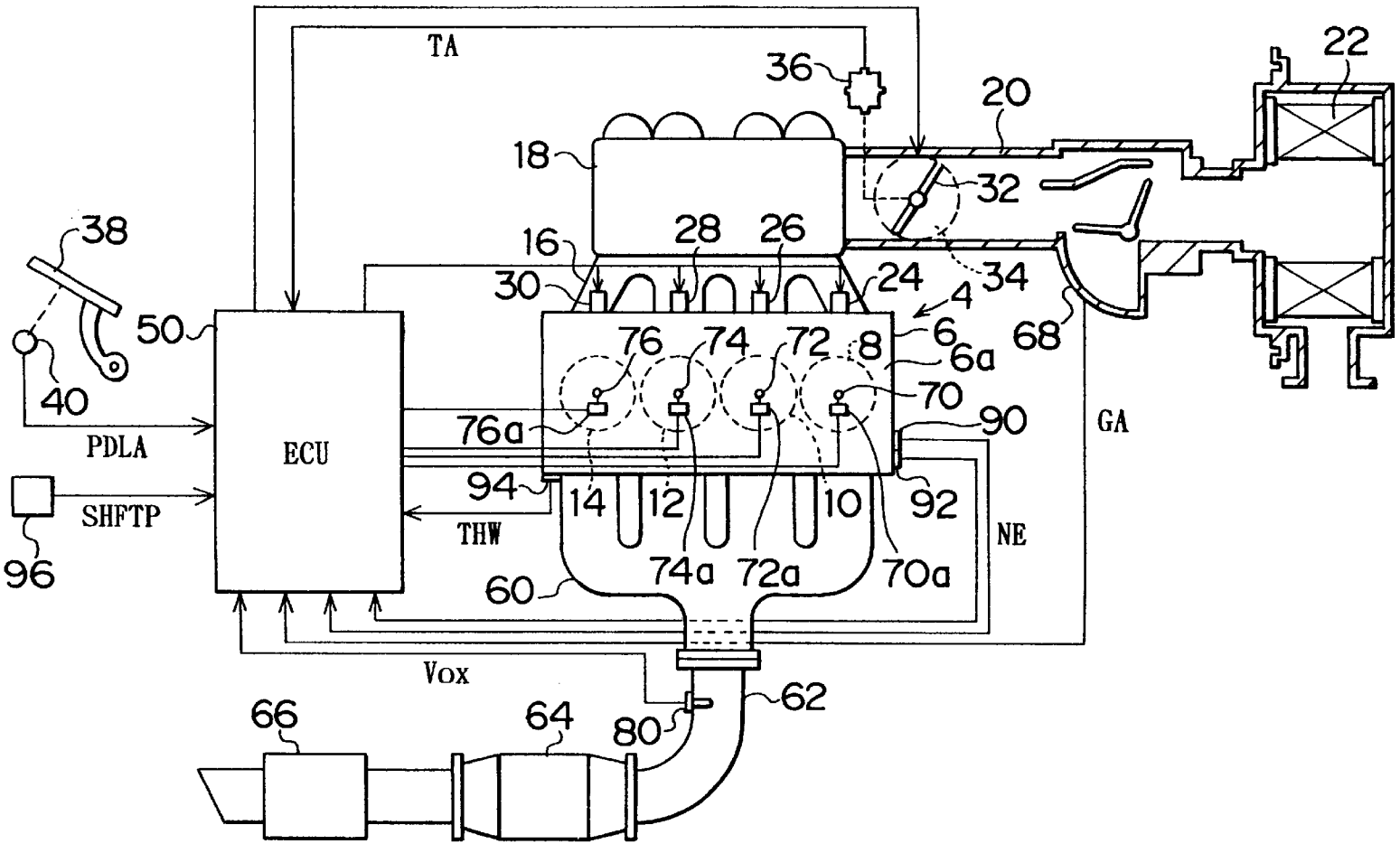
FIG. 1 is a schematic block diagram of a construction of a gasoline engine and a control system thereof according to a first embodiment of the invention.

FIG. 1 is a schematic block diagram of a construction of a gasoline engine (hereinafter, referred to as "engine") 4 and a control system thereof to which the invention is applied.

A cylinder block 6 of the engine 4 has a first cylinder 8, a second cylinder 10, a third cylinder 12, and a fourth cylinder 14, each including a combustion chamber. The cylinders 8–14 are connected to an intake passage 20 via an intake manifold 16 and a surge tank 18. An air cleaner 22 is provided on an upstream side of the intake passage 20. External air is introduced into the intake passage 20 via the air cleaner 22.

Corresponding to the cylinders 8–14, fuel injectors 24, 26, 28, 30 are provided in the intake manifold 16. Each injector 24–30 is an electromagnetic valve that is opened and closed to inject fuel by electrification control. The injectors 24–30 are supplied with pressurized fuel from a fuel tank (not shown) by a fuel pump (not shown). Fuel injected from the injectors 24–30 mixes with intake air in the intake manifold 16 to form an air-fuel mixture. The mixture is then introduced into the combustion chambers of the cylinders 8–14 via intake ports (not shown) by opening intake valves (not shown) that are provided separately for the cylinders 8–14. During air-fuel ratio feedback control, the fuel injection duration of the injectors 24–30 is adjusted based on an air-fuel ratio feedback adjustment coefficient FAFx as described below.

A throttle valve 32 for adjusting the intake air flow is provided in the intake passage 20, that is, upstream of the surge tank 18. The throttle valve 32 is driven in the opening and closing directions by a throttle motor 34 that is provided in the intake passage 20, whereby the extent of opening of the throttle valve 32, that is, the throttle opening extent TA, is adjusted. A throttle sensor 36 is provided near the throttle valve 32. The throttle sensor 36 detects the throttle opening extent TA, and outputs a signal corresponding to the detected throttle opening extent TA.

An accelerator pedal 38 is provided in a driver compartment of the vehicle. The amount of depression of the accelerator pedal 38, that is, the accelerator operation amount PDLA, is detected by an accelerator sensor 40.

Based on the accelerator operation amount PDLA and the like, an electronic control unit (hereinafter, referred to as "ECU") 50 adjusts the throttle opening extent TA to a value corresponding to the engine operating condition by controlling the throttle motor 34. The throttle opening extent TA is further adjusted based on a part of the air-fuel ratio feedback adjustment coefficient FAF during the air-fuel ratio feedback control.

The cylinders 8–14 are connected to an exhaust passage 62 via an exhaust manifold 60. The exhaust passage 62 is provided with a catalytic converter 64 and a muffler 66. Exhaust gas flowing through the exhaust passage 62 is let out via the catalytic converter 64 and the muffler 66.

An air flow meter 68 is provided between the air cleaner 22 and the throttle valve 32 in the intake passage 20. The air flow meter 68 detects an amount of intake air GA introduced into the combustion chamber of each cylinder 8–14, and outputs a signal corresponding to the detected intake air amount GA.

Corresponding to the cylinders 8–14, ignition plugs 70, 72, 74, 76 are provided in a cylinder head 6*a* of the engine 4. The ignition plugs 70–76 are provided with ignition coils 70*a*, 72*a*, 74*a*, 76*a*, and thus form a direct ignition system that does not employ a distributor. The ignition coils 70*a* –76*a* supply a high voltage that is generated at an ignition timing upon discontinuation of a primary current supplied thereto from an ignition drive circuit provided in the ECU 50, directly to the ignition plugs 70–76.

An air-fuel ratio sensor 80 is provided in a portion of the exhaust passage 62 that extends upstream of the catalytic converter 64. The air-fuel ratio sensor 80 outputs a signal Vox corresponding to the air-fuel ratio of mixture based on components of exhaust gas. Based on the signal Vox, the air-fuel ratio feedback control is performed, that is, the amount of fuel injected and the amount of intake air are increased to adjust the air-fuel ratio to a theoretical air-fuel ratio.

A revolution speed sensor 90 outputs a pulse signal having a number of pulses corresponding to the revolution speed NE of the engine 4 based on the rotation speed of a crankshaft (not shown) of the engine 4. A cylinder discriminating sensor 92 for discriminating the cylinders 8–14 outputs a pulse signal that serves as a reference signal, at every predetermined crank angle, based on the rotation speed of the crankshaft. Based on the output signals of the revolution speed sensor 90 and the cylinder discriminating sensor 92, the ECU 50 calculates an engine revolution speed NE and a crank angle, and discriminates the cylinders.

A water temperature sensor 94 for detecting the temperature of engine cooling water is provided in the cylinder block 6. The water temperature sensor 94 outputs a signal corresponding to the detected cooling water temperature THW. A shift position sensor 96 is provided in a transmission (not shown), and outputs a signal corresponding to the shift position SHFTP.

Figure 2:
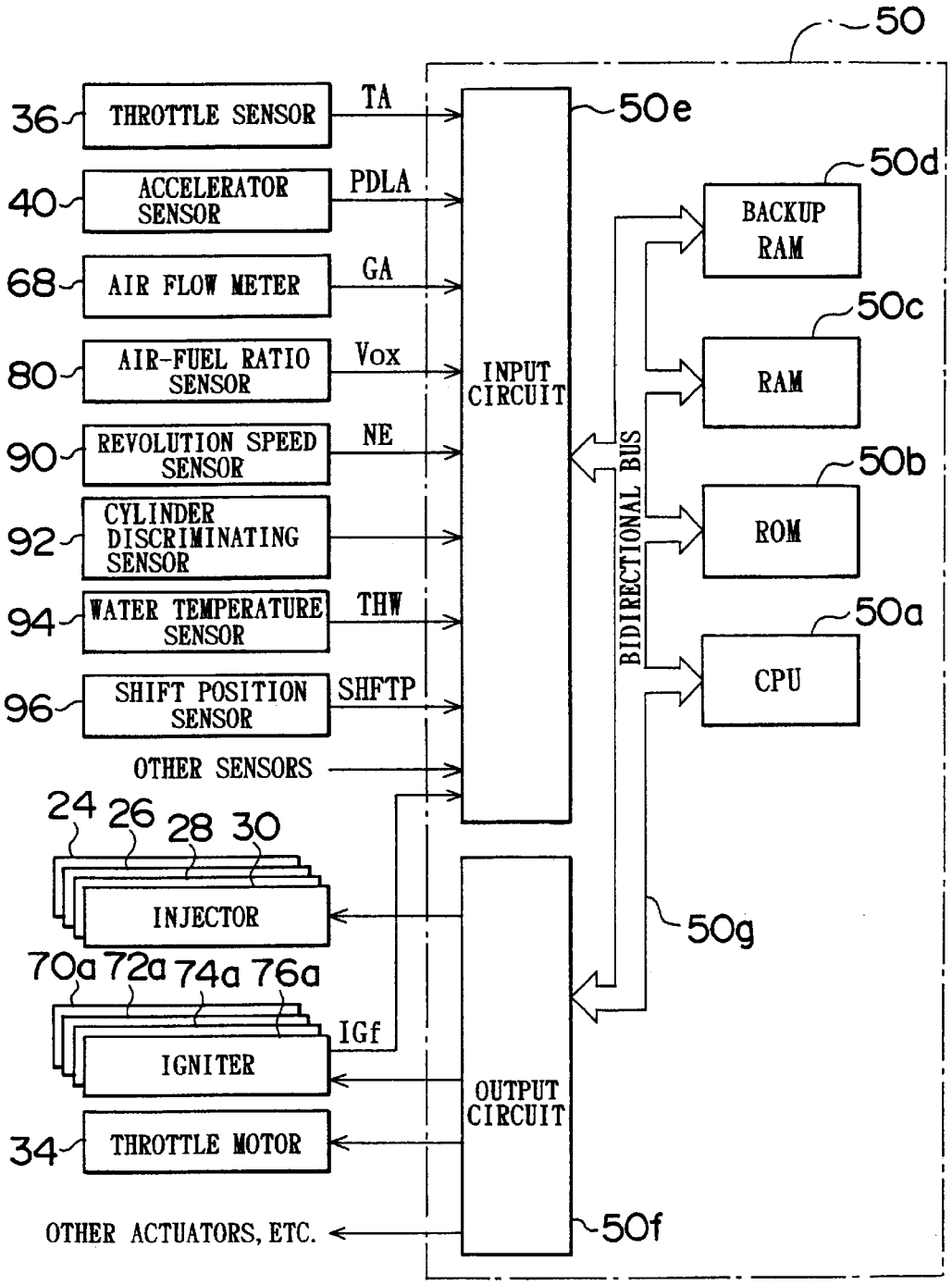
FIG. 2 is a block diagram of a construction of the control system of the first embodiment.

An electrical construction of the control system, which performs the functions of the air-fuel ratio-control apparatus of the first embodiment, will be described with reference to the block diagram of FIG. 2.

The ECU 50 is formed as a logic circuit that has a central processing unit (CPU) 50*a*, a read-only memory (ROM) 50*b*, a random access memory (RAM) 50*c*, a backup RAM 50*d* and the like, which are interconnected together with an input circuit 50*e* and an output circuit 50*f* and the like by a bidirectional bus 50*g*. The ROM 50*b* stores various control programs for the air-fuel ratio feedback control (described below) and the like, and various data. The RAM 50*c* temporarily stores results of calculation or computation performed by the CPU 50*a* during various control operations, and the like.

The input circuit 50*e* is formed as an input interface that includes a waveform shaper circuit, an A/D converter, and the like. The input circuit 50*e* is connected to the throttle sensor 36, the accelerator sensor 40, the air flow meter 68, the air-fuel ratio sensor 80, the revolution speed sensor 90, the cylinder discriminating sensor 92, the water temperature sensor 94, the shift position sensor 96, the line of ignition authentication signals IGf of the ignition coils 70*a* –76*a*, and the like. The output signals of the various sensors 36, 40, 68, 80, 90, 92, 94, 94, and the like are converted into digital signals, and are inputted to the CPU 50*a* via the input circuit 50*e* and the bidirectional bus 50*g*.

The output circuit 50*f* has various drive circuits, and the like. The output circuit 50*f* is connected to the injectors 24–30, the ignition coils 70*a* –76*a*, the throttle motor 34, and the like. Based on the output signals of the various sensors 36, 40, 68, 80, 90, 92, 94, 96, and the like, the ECU 50 performs computations, and then controls the injectors 24–30, the ignition coils 70*a* –76*a*, the throttle motor 34, and the like.

For example, the ECU 50 calculates a load on the engine 4 based on the intake air amount GA detected by the air flow meter 68, the engine revolution speed NE detected by the revolution speed sensor 90, and the like. In accordance with the magnitude of engine load, the ECU 50 controls the fuel injection amount and the fuel injection duration of the injectors 24–30, or controls the ignition timing of the ignition coils 70*a* –76*a*. Furthermore, based on the air-fuel ratio detected by the air-fuel ratio sensor 80, the ECU 50 adjusts the fuel injection amount in the increasing direction by using the injectors 24–30, and adjusts the intake air amount in the increasing direction by using the throttle motor 34, so as to control the air-fuel ratio of the mixture with good precision.

The air-fuel ratio feedback control executed by the ECU 50 in the first embodiment will be described with reference to the flowchart of FIG. 3. Steps in the flowchart corresponding to various processings are referred to as "S . . . " in the below description.

Figure 3:
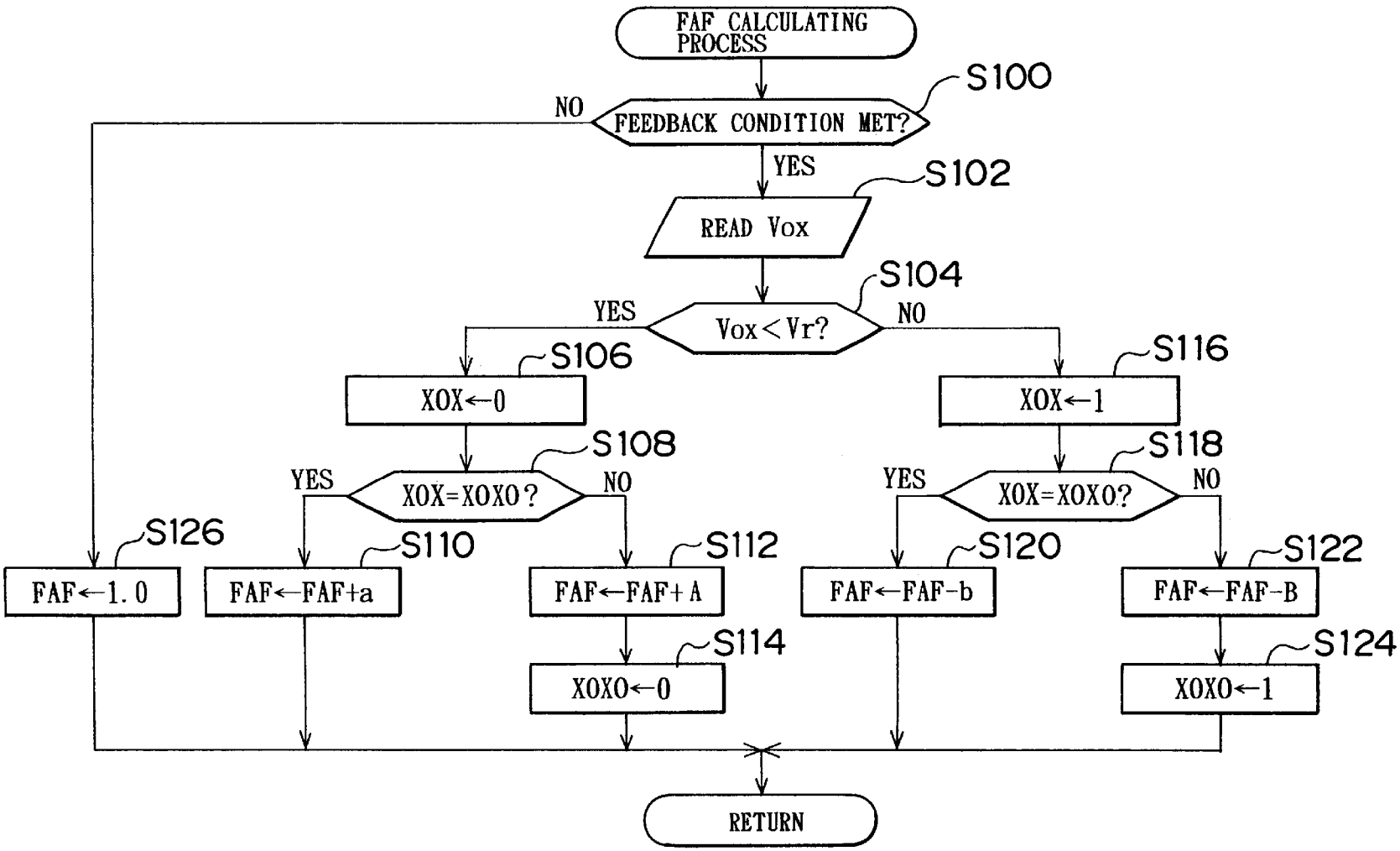
FIG. 3 is a flowchart illustrating an FAF calculating process performed in the first embodiment.

The flowchart of FIG. 3 illustrates an air-fuel ratio feedback adjustment coefficient calculating process (hereinafter, referred to as "FAF calculating process") executed by the ECU 50. This process is periodically executed at every predetermined amount of time.

When this process starts, the ECU 50 determines whether a condition for performing the air-fuel ratio feedback control is met (S100). This condition includes, for example, the following conditions:

(1) The engine is not being started.

(2) Fuel cut is not being performed.

(3) Warm-up has been completed (e.g., cooling water temperature THW≧40° C.).

(4) The air-fuel ratio sensor 80 has been activated.

When all the conditions (1)–(4) are met, the air-fuel ratio feedback control is permitted. If any one of the conditions remains unmet, the air-fuel ratio feedback control is not permitted.

When all the conditions are met (YES in S100), the ECU 50 reads the voltage Vox of the output signal of the air-fuel ratio sensor 80 (S102), and determines whether the voltage Vox is less than a predetermined reference voltage Vr (e.g., 0.45 V) (S104). If Vox<Vr (YES in step S104), it is considered that the air-fuel ratio based on components of exhaust gas is on the lean side of the theoretical air-fuel ratio (the fuel concentration is lower than that corresponding to the theoretical air-fuel ratio). Then, the ECU 50 resets an air-fuel ratio flag XOX (XOX←0) (S106).

Subsequently, the ECU 50 determines whether the air-fuel ratio flag XOX conforms to a state maintenance flag XOXO (S108).

If XOX=XOXO (YES in step S108), it is considered that a fuel-lean state has continued. Then, the ECU 50 increases the air-fuel ratio feedback adjustment coefficient FAF by a lean integral a (a>0) (S110), and temporarily ends the routine.

Conversely, if XOX≠XOXO (NO in S108), it is considered that the air-fuel ratio has switched from a fuel-rich air-fuel ratio (at which the fuel concentration is higher than that corresponding to the theoretical air-fuel ratio) to a fuel-lean air-fuel ratio. Then, the ECU 50 increases the air-fuel ratio feedback adjustment coefficient FAF by a lean skip amount A (A>0) (S112). The lean skip amount A is preset to a value that is sufficiently greater than the lean integral amount a. Subsequently, the ECU 50 resets the state maintenance flag XOXO (XOXO←0) (S114), and temporarily ends the routine.

If it is determined in step S104 that Vox≧Vr (NO in S104), it is determined that the air-fuel ratio based on components of exhaust gas is a fuel-rich air-fuel ratio. Then, the ECU 50 sets up the air-fuel ratio flag XOX (XOX←1) (S116). Subsequently, the ECU 50 determines whether the air-fuel ratio flag XOX conforms to the state maintenance flag XOXO (S118).

If XOX=XOXO (YES in S118), it is determined that a fuel-rich state has continued. Then, the ECU 50 decreases the air-fuel ratio feedback adjustment coefficient FAF by a rich integral amount b (b>0) (S120), and temporarily ends the routine.

If XOX≠XOXO (NO in S118), it is considered that the air-fuel ratio has switched from the lean side to the rich side. Then, the ECU 50 decreases the air-fuel ratio feedback adjustment coefficient FAF by a rich skip amount B (B>0) (S122). The rich skip amount B is preset to a value that is sufficiently greater than the rich integral amount b.

Subsequently, the ECU 50 sets up the state maintenance flag XOXO (XOXO←1) (S124), and temporarily ends the routine. If any one of the conditions is unmet in step S100 (NO in S100), the ECU 50 sets the air-fuel ratio feedback adjustment coefficient FAF to "1.0" (S126), and temporarily ends the routine.

Figures 9A, 9B, 9C, 9D, 9E, 9F:
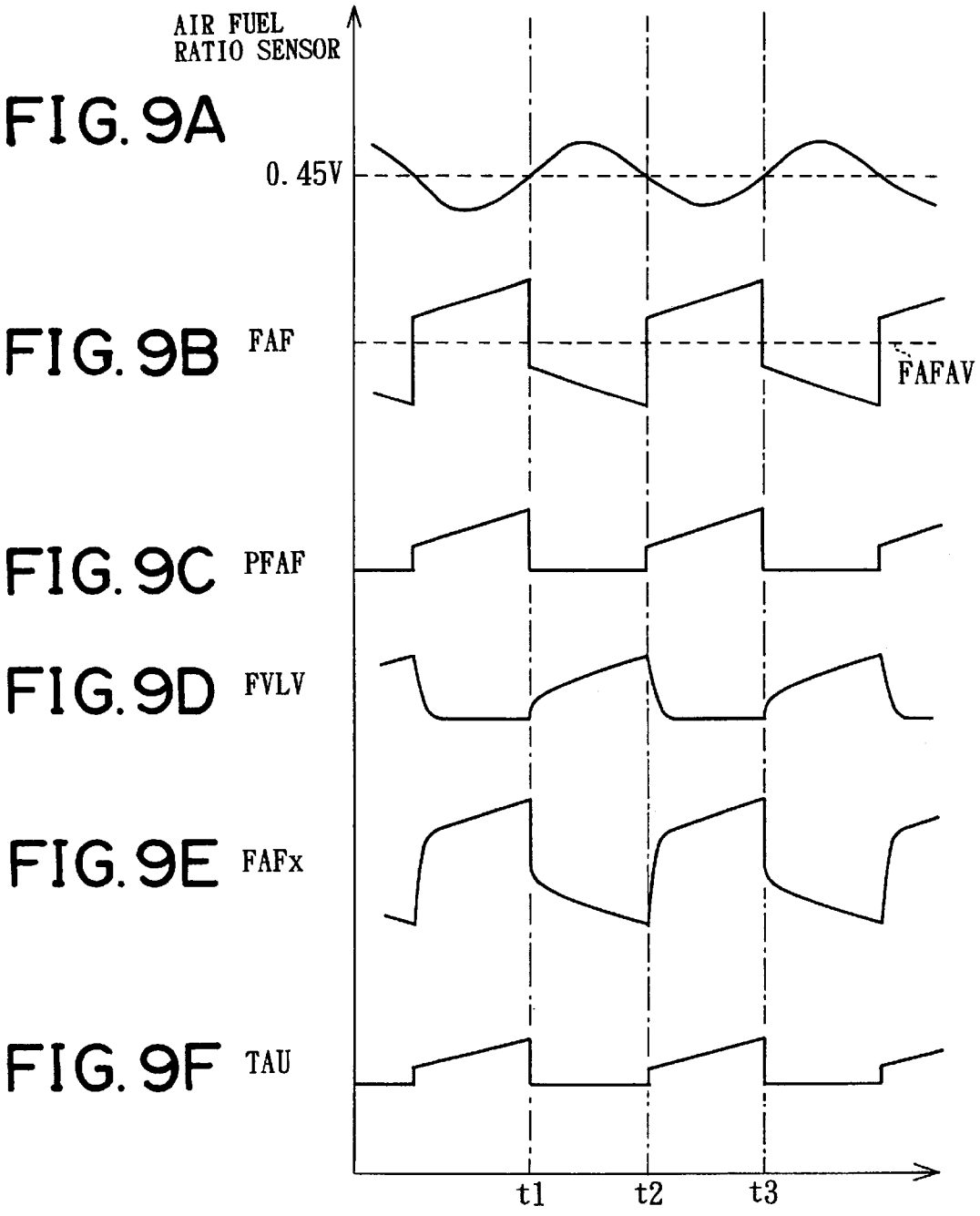
FIGS. 9A to 9F are timing charts illustrating an example of the operation of the first embodiment.
Figures 10A, 10B, 10C, 10D, 10E, 10F, 10G:
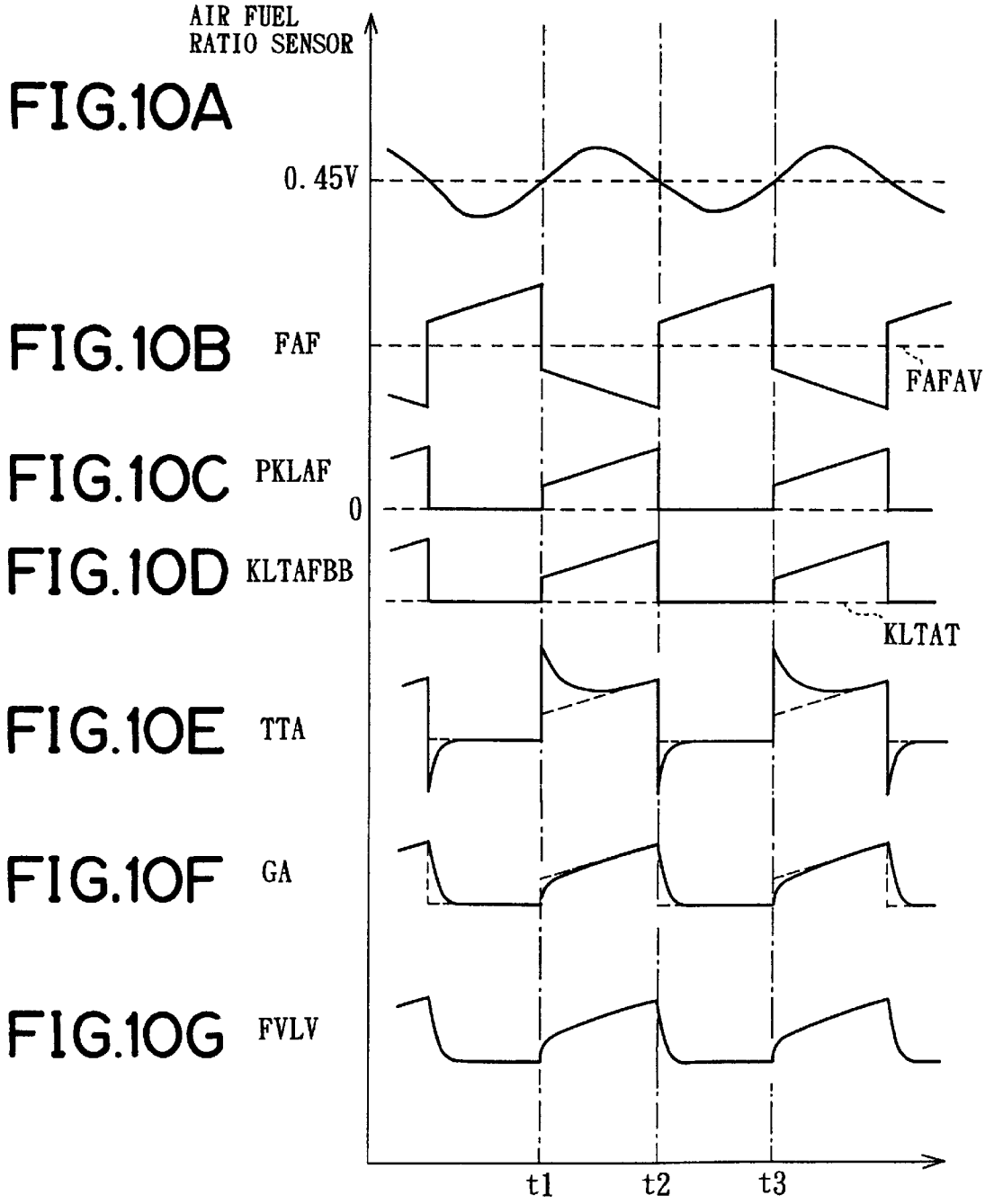
FIGS. 10A to 10G are timing charts illustrating an example of the operation of the first embodiment.

The FAF calculating process is executed as described above to repeatedly determine the air-fuel ratio feedback adjustment coefficient FAF for use in the adjustment of the air-fuel ratio to a target air-fuel ratio. As a result, the air-fuel ratio feedback adjustment coefficient FAF changes in accordance with the output of the air-fuel ratio sensor 80 shown in FIGS. 9A and 10A, as indicated in FIGS. 9B and 10B.

Figure 4:
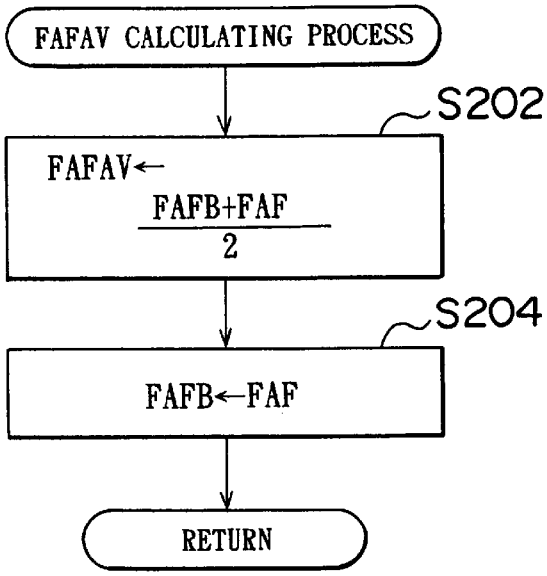
FIG. 4 is a flowchart illustrating an FAFAV calculating process performed in the first embodiment.

FIG. 4 is a flowchart illustrating a process of calculating an average FAFAV of the air-fuel ratio feedback adjustment coefficient FAF (hereinafter, referred to as "FAFAV calculating process"). This process is executed every time the FAF calculating process illustrated in FIG. 3 finds XOX≠XOXO (NO in S108 or S118).

In the FAFAV calculating process, the ECU 50 calculates an average FAFAV of the air-fuel ratio feedback adjustment coefficient FAF and the previous value FAFB as in expression (1) (S202).

$$FAFAV \leftarrow (FAFB+FAF)/2 \quad (1)$$

Subsequently, the ECU 50 substitutes the value FAFB with the present value of the air-fuel ratio feedback adjustment coefficient FAF to prepare for the next calculation (S204). Then, the ECU 50 temporarily ends the process.

Figure 5:
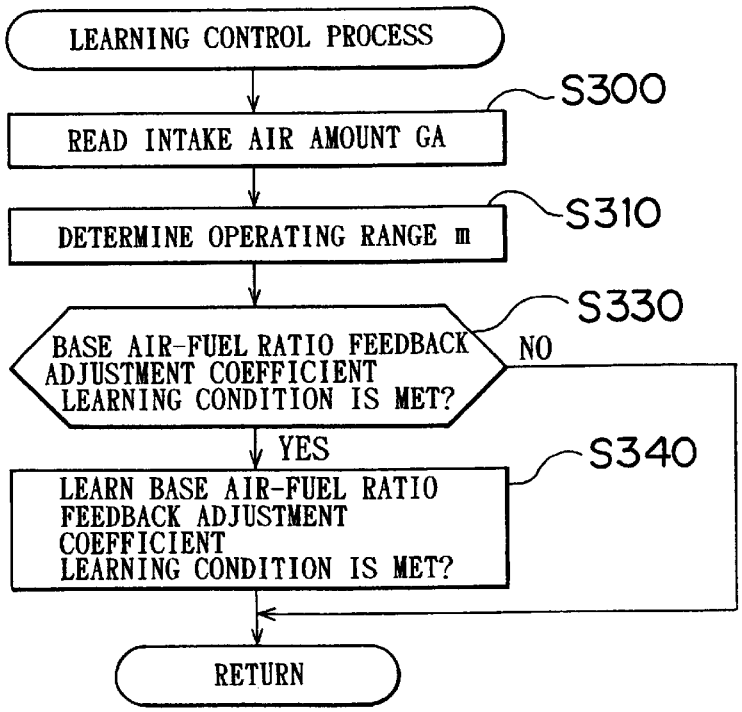
FIG. 5 is a flowchart illustrating a learning control process performed in the first embodiment.

FIG. 5 is a flowchart illustrating a learning control process in which a base air-fuel ratio feedback adjustment coefficient KG is determined as a learned value. This process is also executed at every predetermined amount of time.

When the process starts, the ECU 50 reads an intake air amount GA (g/sec) detected by the air flow meter 68 (S300). Based on the value of the intake air amount GA, the ECU 50 determines an index m that indicates an operating range of the engine 4 (S310). That is, operating ranges of the engine 4 are set by dividing the scale of 0% to 100% of the maximum intake air amount. The index m is determined by finding which one of the ranges includes the present intake air amount GA. The base air-fuel ratio feedback adjustment coefficient KG is determined by performing the learning separately for each operating range of the engine 4. Based on the index m, it is determined which one of the ranges the base air-fuel ratio feedback adjustment coefficient KG belongs to.

Subsequently, the ECU 50 determines whether a condition for learning the base air-fuel ratio feedback adjustment coefficient is met (S330). The condition for learning the base air-fuel ratio feedback adjustment coefficient may include the conditions mentioned above in conjunction with step S100, and may also include, for example, a condition that a stable air-fuel ratio feedback control state is present, which can be determined on the basis of, for example, whether a sufficiently long time has elapsed following a change of the operating range of the engine 4.

If the condition for learning the base air-fuel ratio feedback adjustment coefficient is met (YES in S330), the ECU 50 performs the learning of the base air-fuel ratio feedback adjustment coefficient (described below) with respect to the operating range m of the engine 4 (S340).

Conversely, if the condition for learning the base air-fuel ratio feedback adjustment coefficient is not met (NO in S330), the ECU 50 temporarily ends the process.

Figure 6:
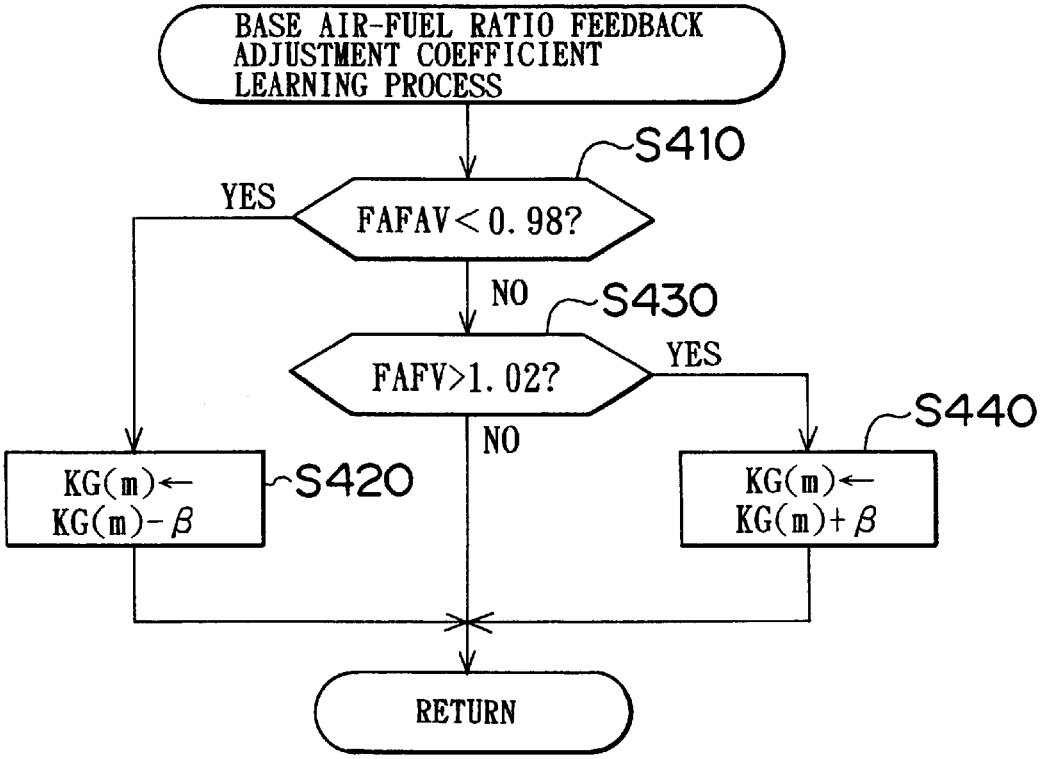
FIG. 6 is a flowchart illustrating a base air-fuel ratio feedback adjustment coefficient learning process performed in the first embodiment.

The process of learning the base air-fuel ratio feedback adjustment coefficient (S340) is illustrated by the flowchart of FIG. 6. In this process, the ECU 50 determines whether the average FAFAV of the air-fuel ratio feedback adjustment coefficient FAF is less than "0.98" (S410). If FAFAV<0.98 (YES in S410), the ECU 50 decreases the base air-fuel ratio feedback adjustment coefficient KG(m) of the operating range m by a changing amount β (β>0), and temporarily ends the process.

If FAFAV≧0.98 (NO in S410), the ECU 50 determines whether the average FAFAV is greater than "1.02" (S430). If FAFAV>1.02 (YES in S430), the ECU 50 increases the base air-fuel ratio feedback adjustment coefficient KG(m) by the changing amount β (S440), and temporarily ends the process.

If 0.98≦FAFAV≦1.02 (NO in S410, and NO in S430), the ECU 50 maintains the value of the base air-fuel ratio feedback adjustment coefficient KG(m) of the operating range (m), and temporarily ends the process.

The initial value of the base air-fuel ratio feedback adjustment coefficient KG(m), which is initially set at the time of power-on of the ECU 50, is set to "0.00".

Figure 7A:
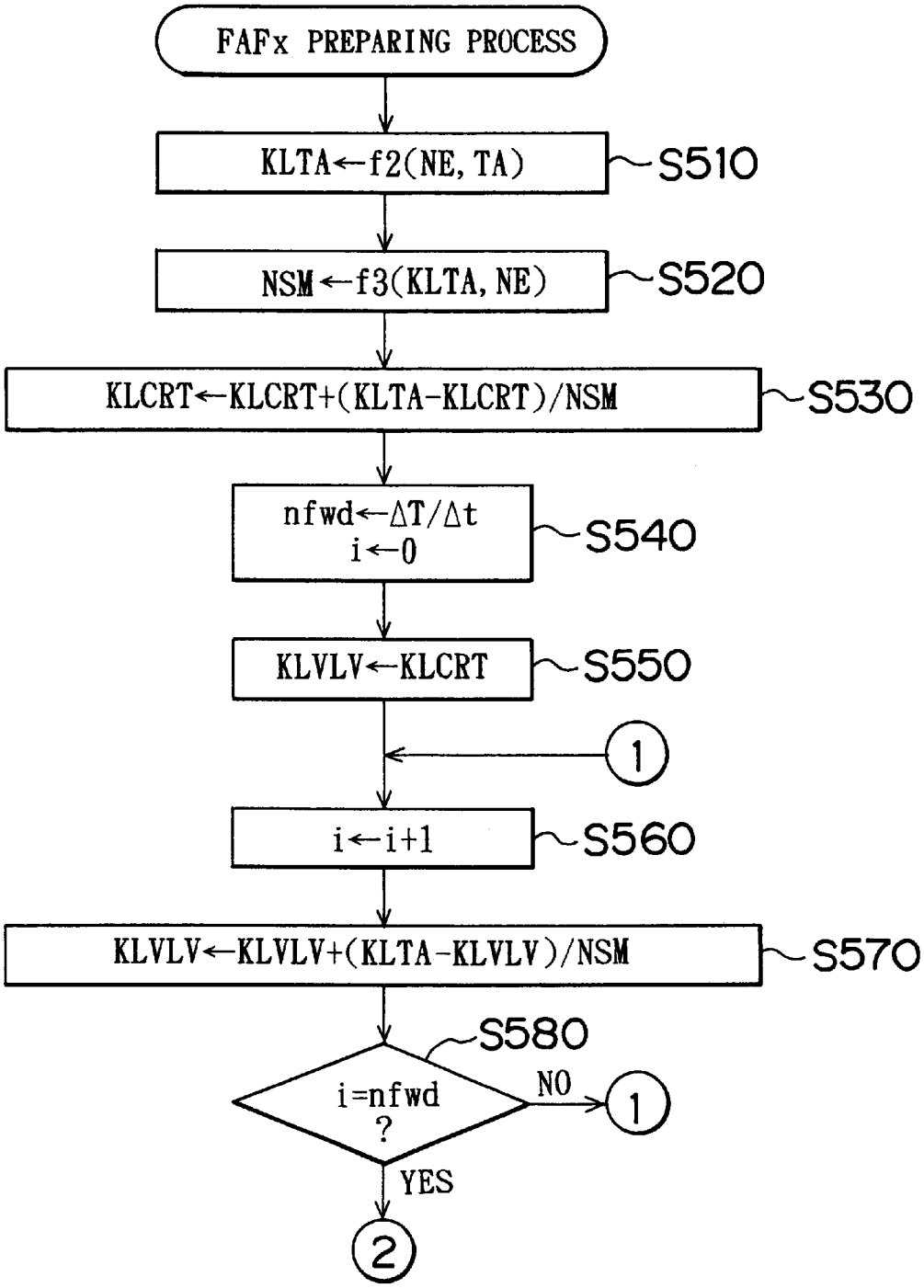
FIGS. 7A, 7B and 7C are a flowchart illustrating an FAFx preparing process performed in the first embodiment.
Figure 7B:
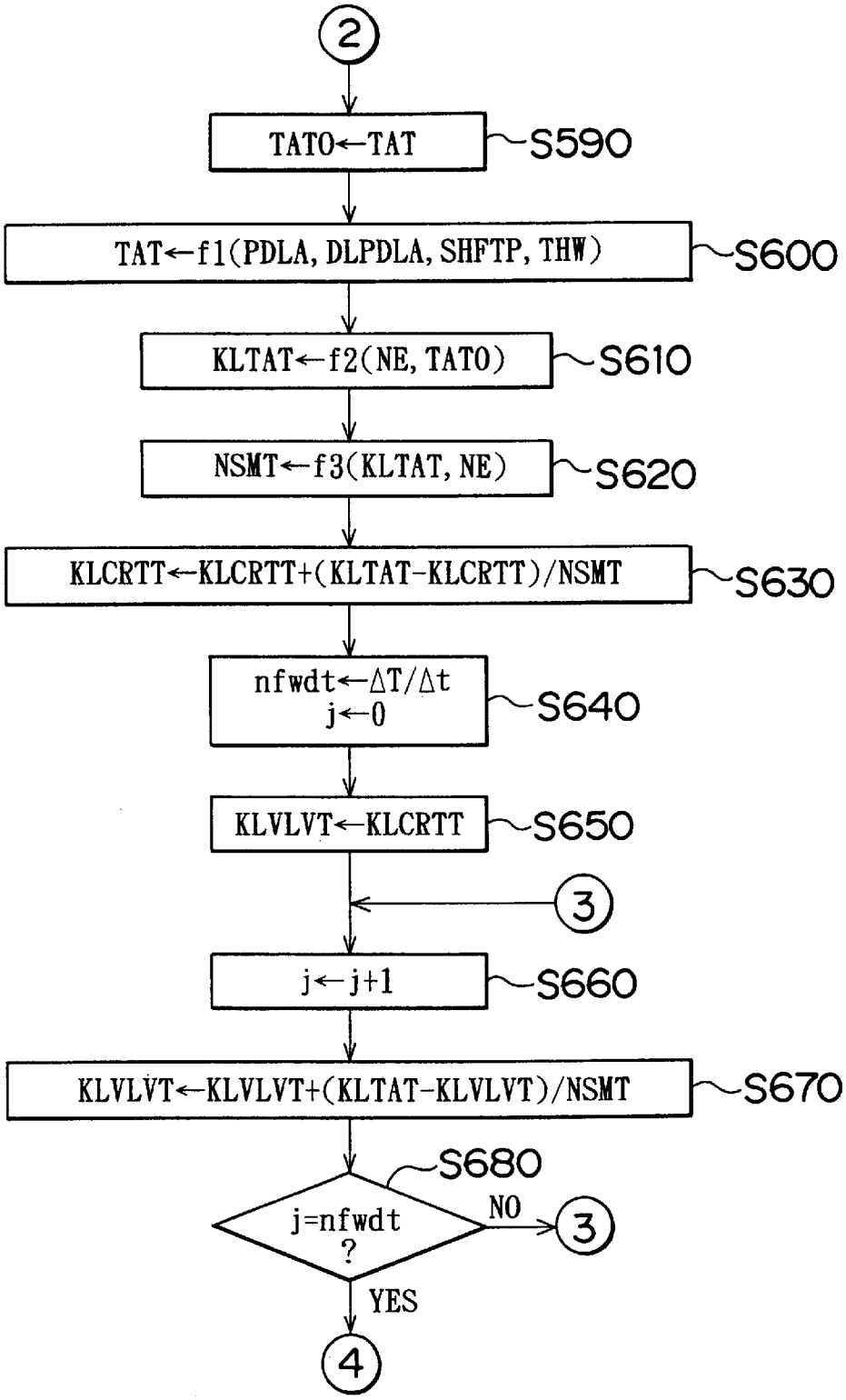
Figure 7C:
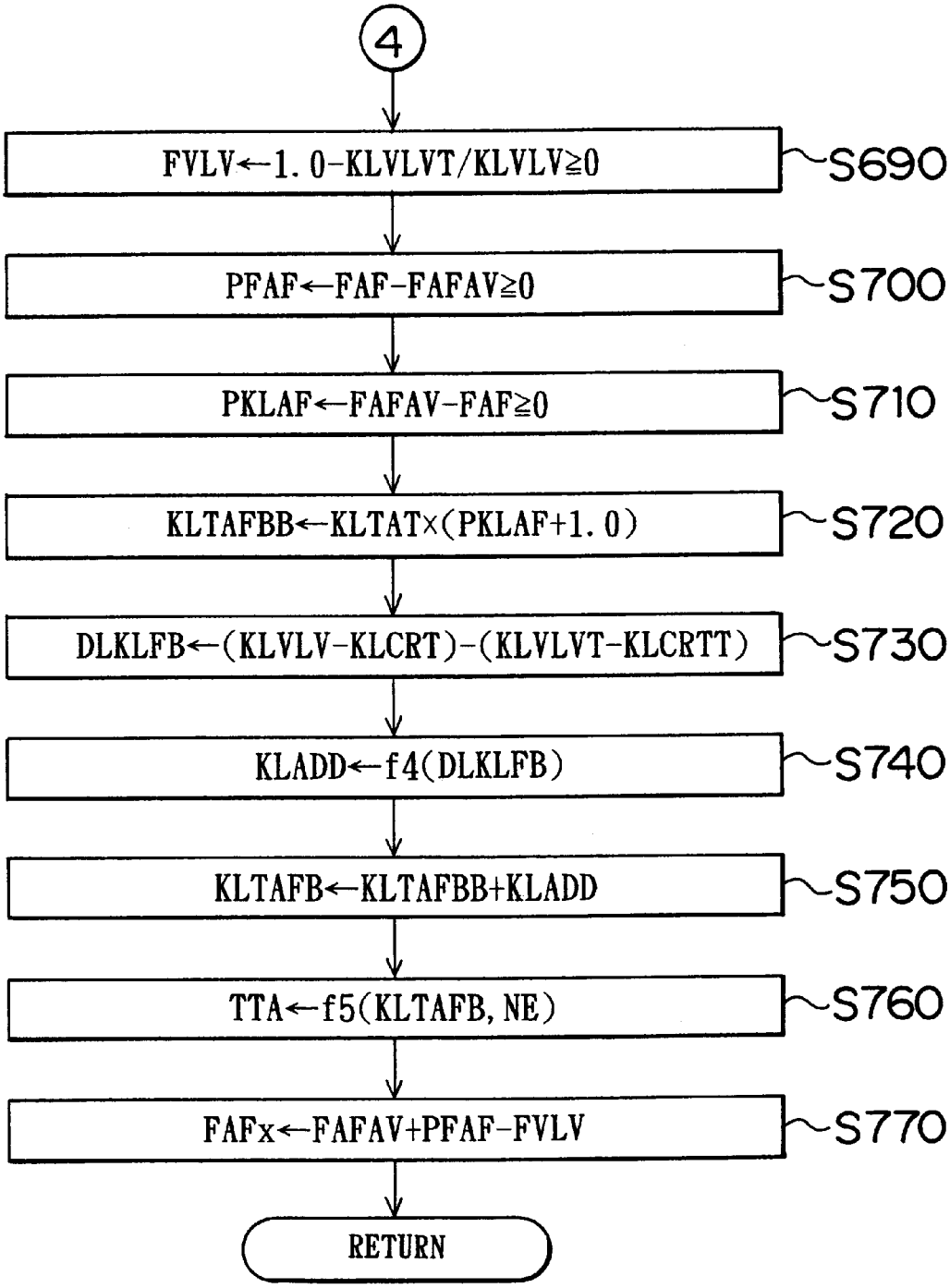

As described above, the ECU 50 executes the process of preparing the air-fuel ratio feedback adjustment coefficient FAFx (hereinafter, referred to as "FAFx preparing process") illustrated in FIGS. 7A to 7C by using the calculated air-fuel ratio feedback adjustment coefficient FAF and the average FAFAV thereof. This process is executed repeatedly in a cycle equal to that of the FAF calculating process illustrated in FIG. 3, when the air-fuel ratio feedback control condition is met.

When the FAFx preparing process starts, the ECU 50 determines an engine charging efficiency KLTA that can be attained during a normal operation under the condition of the present revolution speed NE calculated from the output pulses of the revolution speed sensor 90 and the present throttle opening extent TA detected by the throttle sensor 36 (hereinafter, referred to as "normal charging efficiency"), with reference to a map f2 stored in the ROM 50*b*, based on the revolution speed NE and the throttle opening extent TA (S510 in FIG. 7A).

Subsequently, the ECU 50 determines a response delay time constant NSM of the charging efficiency control of the throttle valve 32 with reference to a map f3 stored in the ROM 50*b*, based on the normal charging efficiency KLTA and the engine revolution speed NE (S520). The response delay time constant NSM is expressed by a positive integer. Then, the ECU 50 calculates a present charging efficiency KLCRT from the time constant NSM, the normal charging efficiency KLTA, and the charging efficiency KLCRT determined in the previous cycle as in expression (2) (S530).

$$KLCRT \leftarrow KLCRT+(KLTA-KLCRT)/NSM \quad (2)$$

Subsequently, in order to calculate a charging efficiency KLVLV at the time of closing the intake valve (hereinafter, referred to as "intake valve closure-time charging efficiency"), the ECU 50 sets a number of times nfwd of carrying out the calculation of expression (3) (presented below) by dividing a time ΔT from the present time point to a time point at which the intake valve is closed by a calculation cycle ΔT, and clears the value of a variable i set in the RAM 50*c* (S540). Then, the ECU 50 sets the present charging efficiency KLCRT determined in step S530, as an initial value of the intake valve closure-time charging efficiency KLVLV (S550).

Subsequently, the ECU 50 increments the value of the variable i (S560), and calculates a new intake valve closure-time charging efficiency KLVLV from the existing intake valve closure-time charging efficiency KLVLV, the response delay time constant NSM, and the normal charging efficiency KLTA as in expression (3) (S570).

$$KLVLV \leftarrow KLVLV+(KLTA-KLVLV)/NSM \quad (3)$$

Subsequently, the ECU 50 determines whether the value of the variable i equals the number of times of calculation nfwd (S580). If i<nfwd still holds (NO in S580) despite the increment in step S560, the ECU 50 increments the value of the variable i again (S560), and calculates a new intake valve closure-time charging efficiency KLVLV by carrying out the calculation of expression (3) (S570). Thus, as long as i<nfwd holds (NO in S580), the calculation of expression (3) is repeated to update the new intake valve closure-time charging efficiency KLVLV (S570).

When i=nfwd holds (YES in S580), the ECU 50 proceeds to the next stage (S590). Thus, the update by expression (3) ends after being performed a number of times corresponding to the number of times nfwd. In this manner, the charging efficiency at the timing of closure of the intake valve is obtained as the intake valve closure-time charging efficiency KLVLV.

After affirmative determination is made in step S580, a throttle opening extent calculated in the previous cycle and not including an air-fuel ratio feedback adjustment amount (hereinafter, referred to as "non-feedback throttle opening extent") TAT is set as a variable TATO that is set in the RAM 50*c*, and the value is stored (S590).

Subsequently, the ECU 50 reads the accelerator operation amount PDLA, the shift position SHFTP, and the cooling water temperature THW detected by the accelerator sensor 40, the shift position sensor 96, and the water temperature sensor 94, respectively. The ECU 50 also calculates an accelerator operation amount changing rate DLPDLA based on the previous accelerator operation amount PDLA and the present accelerator operation amount PDLA. Based on the values PDLA, SHFTP, THW, DLPDLA, the ECU 50 determines a new non-feedback throttle opening extent TAT with reference to a map f1 stored in the ROM 50*b* (S600).

Subsequently, based on a variable TATO that is stored as the non-feedback throttle opening extent TAT determined in the previous cycle (hereinafter, referred to as "previous non-feedback throttle opening extent"), and the revolution speed NE, the ECU 50 determines an engine charging efficiency that can be normally attained under the condition of the present revolution speed NE and the previous non-feedback throttle opening extent TATO (hereinafter, referred to as "non-feedback normal charging efficiency KLTAT") (S610), with reference to the map f2 stored in the ROM 50*b*. The map f2 mentioned herein is the same as the map f2 used in step S510.

Based on the non-feedback normal charging efficiency KLTAT and the revolution speed NE, the ECU 50 determines a response delay time constant of the charging efficiency control of the throttle valve 32 (hereinafter, referred to as "non-feedback time constant NSMT"), with reference to the map f3 stored in the ROM 50*b* (S620). The map f3 mentioned herein is the same as the map f3 used in step S520. The non-feedback time constant NSMT is a positive integer. Subsequently, the ECU 50 calculates a present non-feedback charging efficiency KLCRTT from the non-feedback time constant NSMT, the non-feedback normal charging efficiency KLTAT, and the non-feedback charging efficiency KLCRTT determined in the previous cycle, as in expression (4) (S630).

$$KLCRTT \leftarrow KLCRTT+(KLTAT-KLCRTT)/NSMT \quad (4)$$

Subsequently, in order to calculate a charging efficiency at the time of closing the intake valve (hereinafter, referred to as "non-feedback intake valve closure-time charging efficiency KLVLVT"), the ECU 50 sets a number of times nfwdt of carrying out the calculation of expression (5) by dividing a time ΔT from the present time point to a time point at which the intake valve is closed by a calculation cycle ΔT, and clears the value of a variable j set in the RAM 50*c* (S640). Then, the ECU 50 sets the present non-feedback charging efficiency KLCRTT determined in step S630, as an initial value of the non-feedback intake valve closure-time charging efficiency KLVLVT (S650).

Subsequently, the ECU 50 increments the value of the variable j (S660), and calculates a new non-feedback intake valve closure-time charging efficiency KLVLVT from the existing non-feedback intake valve closure-time charging efficiency KLVLVT, the non-feedback time constant NSMT, and the non-feedback normal charging efficiency KLTAT as in expression (5) (S670).

$$KLVLVT \leftarrow KLVLVT+(KLTAT-KLVLVT)/NSMT \quad (5)$$

Subsequently, the ECU 50 determines whether the value of the variable j equals the number of times of calculation nfwdt (S680). If j<nfwdt holds (NO in S680) despite the increment in step S660, the ECU 50 increments the value of the variable j again (S660), and calculates a new non-feedback intake valve closure-time charging efficiency KLVLVT by carrying out the calculation of expression (5) (S670). Thus, as long as j<nfwdt holds (NO in S680), the calculation of expression (5) is repeated to update the new non-feedback intake valve closure-time charging efficiency KLVLVT (S670).

When j=nfwdt holds (YES in S680), the ECU 50 proceeds to the next stage (S690). Thus, the update by expression (5) ends after being performed a number of times corresponding to the number of times nfwdt. In this manner, the charging efficiency at the timing of closure of the intake valve in a condition where the air-fuel ratio feedback control is not being performed is obtained as the non-feedback intake valve closure-time charging efficiency KLVLVT.

After affirmative determination is made in step S680, an air-fuel ratio-increasing feedback adjustment coefficient FVLV is calculated as in expression (6) (S690).

$$FVLV \leftarrow 1.0 - KLVLVT/KLVLV \geqq 0 \quad (6)$$

In expression (6), "≧0" means that if the value of "1.0−KLVLVT/KLVLV" is equal to or greater than "0", the value is set as FVLV, but that if the value is less than "0", "0" is set as FVLV. An example of the air-fuel ratio-increasing feedback adjustment coefficient FVLV is indicated in FIGS. 9D and 10G.

Subsequently, of the air-fuel ratio feedback adjustment coefficient FAF determined in the FAF calculating process, portions in such a region as to increase the fuel concentration of the mixture are determined as an air-fuel ratio-decreasing feedback adjustment coefficient PFAF as in expression (7) (S700).

$$PFAF \leftarrow FAF - FAFAV \geqq 0 \quad (7)$$

In expression (7), "≧0" means the same as in expression (6). Therefore, as indicated in FIG. 9C, the air-fuel ratio-decreasing feedback adjustment coefficient PFAF corresponds to portions of the air-fuel ratio feedback adjustment coefficient FAF (indicated in FIG. 9B) that are greater than the average FAFAV, that is, the portions in such a region as to increase the fuel concentration.

Subsequently, of the air-fuel ratio feedback adjustment coefficient FAF determined in the FAF calculating process, portions in such a region as to decrease the fuel concentration in the mixture are determined as a segmental air-fuel ratio feedback adjustment coefficient PKLAF as in expression (8) (S710).

$$PKLAF \leftarrow FAFAV - FAF \geqq 0 \quad (8)$$

In expression (8), "≧0" means the same as in expression (6). Therefore, as indicated in FIG. 10C, the segmental air-fuel ratio feedback adjustment coefficient PKLAF corresponds to portions of the air-fuel ratio feedback adjustment coefficient FAF (indicated in FIG. 10B) that are less than the average FAFAV, that is, the portions thereof in such a region as to decrease the fuel concentration, and, more specifically, is equivalent to the portions reversed in sign to the positive.

Subsequently, the non-feedback normal charging efficiency KLTAT determined in step S610 is adjusted by using the segmental air-fuel ratio feedback adjustment coefficient PKLAF calculated as in expression (8) to provide a feedback normal charging efficiency KLTAFBB as in expression (9) (S720).

$$KLTAFBB \leftarrow KLTAT \times (PKLAF + 1.0) \quad (9)$$

As a result, the feedback normal charging efficiency KLTAFBB has a form that is obtained by adjusting the non-feedback normal charging efficiency KLTAT through the use of the pattern of the air-fuel ratio feedback adjustment coefficient FAF occurring on the side of air-fuel ratio-increasing region, as indicated in FIG. 10D.

Subsequently, a difference DLKLFB between the charging efficiency at the time of closure of the intake valve and the present charging efficiency achieved by the air-fuel ratio feedback control is determined as in expression (10) (S730).

$$DLKLFB \leftarrow (KLVLV - KLCRT) - (KLVLVT - KLCRTT) \quad (10)$$

In expression (10), "KLVLV−KLCRT" represents the difference between the charging efficiency at the time of closure of the intake valve and the present charging efficiency during the actual intake air adjustment, and "KLVLVT−KLCRTT" represents the difference between the charging efficiency at the time of closure of the intake valve and the present charging efficiency during the intake air adjustment based on the driver's operation of the accelerator pedal 38. Therefore, through the calculation of expression (10), the difference DLKLFB between the charging efficiency at the time of closure of the intake valve and the present charging efficiency achieved by the air-fuel ratio feedback control can be determined.

Figure 11:
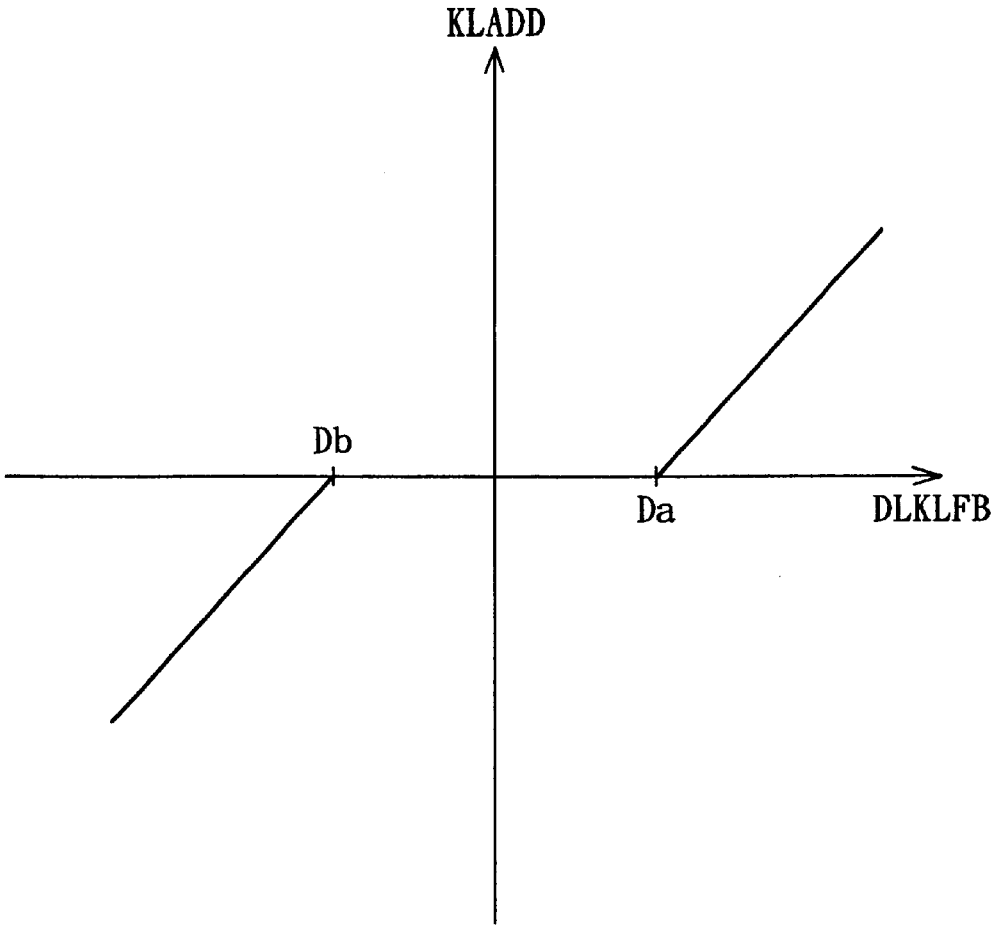
FIG. 11 indicates a map used in the first embodiment to determine a charging efficiency adjustment amount KLADD from a difference KLKLFB between the intake valve closure-time charging efficiency and the present charging efficiency achieved by the air-fuel ratio feedback control.

Subsequently, based on the difference DLKLFB provided by expression (10), the ECU 50 determines a charging efficiency adjustment amount KLADD with reference to a map f4 stored in the ROM 50*b* (S740). The map f4 is prepared as indicated in FIG. 11. That is, when the difference KLDLFB is within the range of Db (<0) to Da (>0), the charging efficiency adjustment amount KLADD equals "0". Where the difference DLKLFB<Db, the charging efficiency adjustment amount KLADD decreases below "0" with decreases in the difference DLKLFB. Where the difference DLKLFB>Da, the charging efficiency adjustment amount KLADD increases above "0" with increases in the difference DLKLFB.

Subsequently, the ECU 50 determines a charging efficiency instruction value KLTAFB by adding the charging efficiency adjustment amount KLADD determined in step S740 to the feedback normal charging efficiency KLTAFBB determined in step S720, as in expression (11) (S750).

$$KLTAFB \leftarrow KLTAFBB + KLADD \quad (11)$$

Subsequently, based on the charging efficiency instruction value KLTAFB and the revolution speed NE, the ECU 50 determines a target throttle opening extent TTA with reference to a map f5 stored in the ROM 50*b*, as indicated FIG. 10E (S760). Thus, through the throttle opening extent feedback control (not illustrated), the throttle motor 34 is controlled so that the throttle opening extent TA becomes equal to the target throttle opening extent TTA.

Thus, since the charging efficiency adjustment amount KLADD is reflected in the target throttle opening extent TTA in order to improve the responsiveness of the intake air amount GA, the intake air amount GA changes similarly to the segmental air-fuel ratio feedback adjustment coefficient PKLAF, as indicated in FIG. 10F.

Subsequently, the ECU 50 calculates a new air-fuel ratio feedback adjustment coefficient FAFx as in expression (12) (S770).

$$FAFx \leftarrow FAFAV + PFAF - FVLV \quad (12)$$

That is, the air-fuel ratio feedback adjustment coefficient FAFx as indicated in FIG. 9E is prepared from the average FAFAV of the air-fuel ratio feedback adjustment coefficient FAF, the air-fuel ratio-decreasing feedback adjustment coefficient PFAF indicated in FIG. 9C, and the air-fuel ratio-increasing feedback adjustment coefficient FVLV indicated in FIG. 9D.

Then, the ECU 50 temporarily ends the process. In the next cycle, the ECU 50 restarts the FAFx preparing process at step S510.

Figure 8:
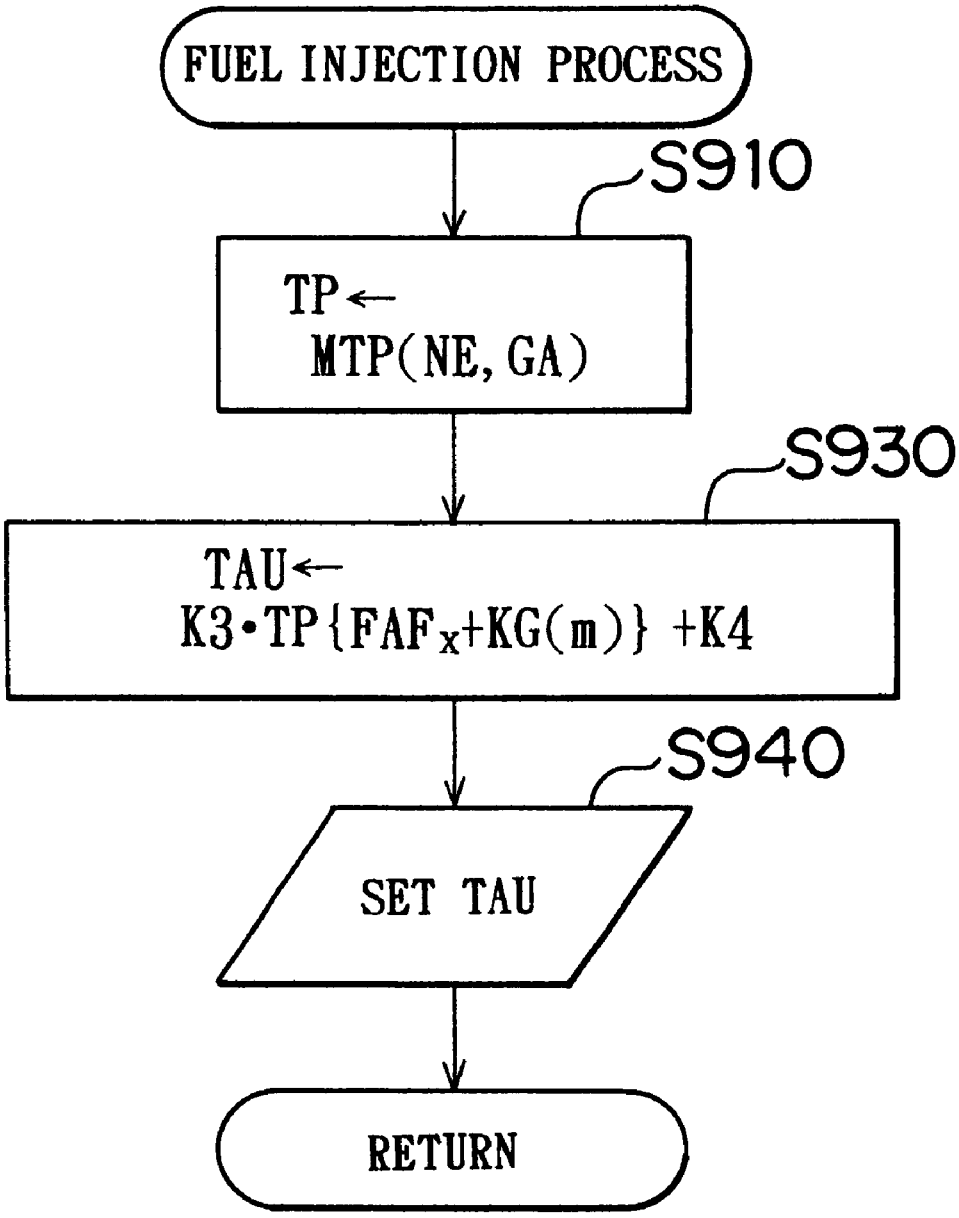
FIG. 8 is a flowchart illustrating a fuel injection process performed in the first embodiment.

Based on the air-fuel ratio feedback adjustment coefficient FAFx calculated as described above and the base air-fuel ratio feedback adjustment coefficient KG(m) determined as described above, the ECU 50 executes a fuel injection process illustrated in the flowchart of FIG. 8. This process is periodically executed by an interrupt at every predetermined crank angle.

When the process starts, the ECU 50 determines a basic fuel injection valve open duration TP with reference to a map MTP stored in the ECU 50*b*, based on the engine revolution speed NE and the intake air amount GA (S910).

Subsequently, based on the new air-fuel ratio feedback adjustment coefficient FAFx calculated in the FAFx preparing process (FIGS. 7A to 7C) and the base air-fuel ratio feedback adjustment coefficient KG(m) calculated in the base air-fuel ratio feedback adjustment coefficient-learning process illustrated in FIG. 6, the ECU 50 calculates a fuel injection valve open duration TAU as in expression (13) (S930).

$$TAU \leftarrow K3 \times TP \times \{FAFx + KG(m)\} + K4 \quad (13)$$

where K3 and K4 are adjustment coefficients that include a warm-up increase, a start-up increase, and the like. Subsequently, the ECU 50 outputs the fuel injection valve open duration TAU (S940), and temporarily ends the process.

Thus, due to the air-fuel ratio feedback control, the fuel injection valve open duration TAU changes in a pattern as indicated in FIG. 9F. That is, when the fuel concentration in the air-fuel mixture is increased by the air-fuel ratio feedback control (time t2 to t3), the amount of fuel supplied is increased. However, when the fuel concentration in the mixture is decreased by the air-fuel ratio feedback control (time t1 to t2), the adjustment of air-fuel ratio based on a decrease in the amount of fuel supplied is not performed. Instead, the throttle opening extent TA is controlled as indicated in FIG. 10E so as to increase the intake air amount GA as indicated in FIG. 10F, so that the fuel concentration in the mixture decreases.

In the first embodiment, the air-fuel ratio sensor 80 corresponds to an air-fuel ratio detector, and the air flow meter 68 corresponds to an intake air amount detector, and the throttle valve 32 and the throttle motor 34 correspond to an intake air amount adjuster. The ECU 50 corresponds to a control system according to the invention. The FAF calculating process illustrated in FIG. 3 corresponds to a process of calculating an air-fuel ratio feedback adjustment coefficient. Steps S710–S760 correspond to a fuel concentration-decreasing process. Steps S510–690 correspond to a process of calculating an air-fuel ratio-increasing feedback adjustment coefficient Step S700 corresponds to a process of calculating a fuel concentration-increasing region air-fuel ratio feedback adjustment coefficient. The fuel injection process illustrated in FIG. 8 corresponds to a process of controlling the amount of fuel supplied.

As is apparent from the above description, the first embodiment achieves the following advantages.

(a) In steps S710–S760, the amount of intake air is increased based on the segmental air-fuel ratio feedback adjustment coefficient PKLAF representing portions of the air-fuel ratio feedback adjustment coefficient FAF that are present in such a region as to decrease the fuel concentration in the mixture.

In step S930 in the fuel injection process (FIG. 8), the fuel injection valve open duration TAU is calculated by using the air-fuel ratio feedback adjustment coefficient FAFx prepared in step S770, instead of using the air-fuel ratio feedback adjustment coefficient FAF determined in the FAF calculating process. The air-fuel ratio-increasing feedback adjustment coefficient FVLV, that is, a component of the air-fuel ratio feedback adjustment coefficient FAFx that is located on the fuel concentration-decreasing side, has a value that cancels the increase in the amount of intake air based on the segmental air-fuel ratio feedback adjustment coefficient PKLAF.

Therefore, in step S930 in the fuel injection process (FIG. 8), the fuel injection amount is not decreased when the fuel concentration in the air-fuel mixture is to be decreased by the air-fuel ratio feedback control. Only when the fuel concentration in the mixture is to be increased by the air-fuel ratio feedback control, the fuel injection amount is adjusted based on the air-fuel ratio-decreasing feedback adjustment coefficient PFAF (portions of the air-fuel ratio feedback adjustment coefficient FAF that are present in such a region as to increase the fuel concentration in the mixture).

In this manner, the fuel concentration in the mixture is increased by the fuel-increasing process, and the fuel concentration in the mixture is decreased by the intake air-increasing process. That is, the process of increasing the fuel concentration in the mixture and the process of decreasing the fuel concentration in the mixture are both performed by increasing physical quantities, although the two processes employ different physical quantities (the amount of fuel and the amount of intake air).

Therefore, the torque difference between the fuel concentration-increasing control and the fuel concentration-decreasing control is reduced. Hence, the torque fluctuation caused during the air-fuel ratio feedback control of the engine 4 can be reduced, and the drivability can be improved.

(b) If the amount of intake air is increased on the basis of the segmental air-fuel ratio feedback adjustment coefficient PKLAF, the intake air amount control normally experiences a reduced responsiveness, unlike the fuel injection amount control. However, the process of steps S730–S760 reflects the charging efficiency adjustment amount KLADD in the target throttle opening extent TTA so as to improve the responsiveness of the intake air amount GA. Therefore, as indicated in FIG. 10F, the intake air amount GA changes similarly to the segmental air-fuel ratio feedback adjustment coefficient PKLAF. Hence, an air-fuel ratio feedback control with higher precision can be performed, in comparison with a case where the intake air amount is increased merely through adjustment of the throttle opening extent TA in accordance with the segmental air-fuel ratio feedback adjustment coefficient PKLAF.

(c) The air-fuel ratio-increasing feedback adjustment coefficient FVLV, that is, a component of the air-fuel ratio feedback adjustment coefficient FAFx that exists on the fuel concentration-decreasing side, has a value that cancels the increase in the intake air amount based on the segmental air-fuel ratio feedback adjustment coefficient PKLAF. Therefore, it becomes possible to perform the air-fuel ratio feedback control by increasing the intake air amount for a decrease in the fuel concentration in the air-fuel mixture and by increasing the amount of fuel for an increase in the fuel concentration, without a need to change the processing contents (FIG. 3, FIG. 8, and the like) of the air-fuel ratio feedback control, which is essentially based on adjustment of the amount of fuel supplied.

Therefore, by using the processing contents of an air-fuel ratio feedback system that is based on the air-fuel ratio feedback control based on the increasing and decreasing of the amount of fuel supplied, the construction described above in conjunction with the first embodiment can be realized while the changes in the programs are minimized. Thus, the costs caused by changes in the programs are minimized.

Other embodiments of the invention can be used. For example, while the fuel concentration in the air-fuel mixture is increased in the first embodiment by the fuel-increasing process, and is decreased by the intake air-increasing process, processes in the opposite directions may also be employed. That is, the fuel concentration in the mixture may be increased by a process of decreasing the intake air amount, and may be decreased by a process of decreasing the amount of fuel.

In that case, the increasing and the decreasing of the fuel concentration in the mixture can both be accomplished by processes of decreasing physical amounts although the decreasing processes employ different physical amounts (the intake air amount and the fuel amount). Therefore, the torque difference between the fuel concentration-increasing control and the fuel concentration-decreasing control becomes small. Hence, the torque fluctuation during the air-fuel ratio feedback control of an internal combustion engine can be reduced, and the drivability can be improved.

The first embodiment is based on the air-fuel ratio feedback control in which the state of air-fuel ratio is reflected in the increase or decrease of the fuel injection amount, as illustrated in FIG. 8. However, the invention is also applicable to a system that is based on an air-fuel ratio feedback control in which the state of air-fuel ratio is reflected in the increase or decrease of the intake air amount.

Moreover, although the first embodiment employs the air-fuel ratio sensor 80 capable of detecting the oxygen concentration in a broad range as an air-fuel ratio detector, the invention can also be realized by employing an oxygen sensor that is capable of detecting the oxygen concentration only in a limited range around the theoretical air-fuel ratio.

Further, while in the first embodiment the air-fuel ratio sensor 80 is disposed upstream of the catalytic converter 64, the invention is also applicable to a system in which an air-fuel ratio sensor 80 is disposed downstream of the catalytic converter 64 and the air-fuel ratio detected by the air-fuel ratio sensor 80 is fed back, or a system in which air-fuel ratio sensors 80 are disposed upstream and downstream of the catalytic converter 64 and data from both sensors are fed back, or the like.

Furthermore, although the first embodiment employs the air flow meter 68 as an intake air amount detector, an intake pressure sensor may instead be employed as an intake air amount detector. In that case, the intake pressure is detected as a physical quantity that indicates the amount of intake air, and is used for the control Still further, although in the first embodiment the internal combustion engine is of a type in which fuel is injected into the intake passage such as the intake manifold 16 or the like, the invention is also applicable to a direct injection type internal combustion engine in which fuel is injected directly into cylinders.

In the illustrated embodiment, the control system (ECU 50) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller also can be a plurality of separate dedicated or programmable integrated or other electronic circuits or devices (e.g., hard-wired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein and in the flowcharts shown in FIGS. 3–8 can be used as the controller. A distributed processing architecture can be used for maximum data/signal processing capability and speed.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. An air-fuel ratio control apparatus for an internal combustion engine, comprising:

an air-fuel ratio detector that detects an air-fuel ratio of an air-fuel mixture supplied to the internal combustion engine; and a control system that increases a fuel concentration in the air-fuel mixture by a process of increasing an amount of fuel supplied, when the air-fuel ratio detected by the detector indicates a lower fuel concentration than a target air-fuel ratio, and that decreases the fuel concentration in the air-fuel mixture by a process of increasing the amount of intake air, when the air-fuel ratio detected by the detector indicates a higher fuel concentration than the target air-fuel ratio.

2. An air-fuel ratio control apparatus for an internal combustion engine according to claim 1, further comprising:

an intake air amount detector that detects an amount of intake air taken into the internal combustion engine; and an intake air amount adjustor that adjusts the amount of intake air taken into the internal combustion engine, wherein the control system:

(a) determines an air-fuel ratio feedback adjustment coefficient that is reflected in a fuel concentration in the air-fuel mixture, based on the air-fuel ratio detected by the air-fuel ratio detector, and (b) performs an intake air-increasing process by using the intake air amount adjustor, based on an air-fuel ratio feedback adjustment coefficient that is in such a range as to decrease the fuel concentration in the air-fuel mixture, and (c) determines an air-fuel ratio-increasing feedback adjustment coefficient based on an increased amount of intake air that cancels an amount of fuel corresponding to the increased amount of intake air, (d) extracts, as an air-fuel ratio-decreasing feedback adjustment coefficient, an air-fuel ratio feedback adjustment coefficient that is in such a range as to increase the fuel concentration in the air-fuel mixture, and (e) adjusts an amount of fuel supplied to the internal combustion engine, based on the air-fuel ratio-increasing feedback adjustment coefficient, the air-fuel ratio-decreasing feedback adjustment coefficient, and the amount of intake air detected by the intake air amount detector.

3. An air-fuel ratio control apparatus for an internal combustion engine, comprising:

an air-fuel ratio detector that detects an air-fuel ratio of an air-fuel mixture supplied to the internal combustion engine; and a control system that increases a fuel concentration in the air-fuel mixture by a process of decreasing an amount of intake air, when the air-fuel ratio detected by the detector indicates a lower fuel concentration than a target air-fuel ratio, and that decreases the fuel concentration in the air-fuel mixture by a process of decreasing the amount of fuel supplied, when the air-fuel ratio detected by the detector indicates a higher fuel concentration than the target air-fuel ratio.

4. An air-fuel ratio control apparatus for an internal combustion engine according to claim 3, further comprising:

an intake air amount detector that detects an amount of intake air taken into the internal combustion engine; and an intake air amount adjustor that adjusts the amount of intake air taken into the internal combustion engine, wherein the control system:

(a) determines an air-fuel ratio feedback adjustment coefficient that is reflected in a fuel concentration in the air-fuel mixture, based on the air-fuel ratio detected by the air-fuel ratio detector, (b) performs an intake air-decreasing process by using the intake air amount adjustor, based on an air-fuel ratio feedback adjustment coefficient that is in such a range as to increase the fuel concentration in the air-fuel mixture, (c) determines an air-fuel ratio-decreasing feedback adjustment coefficient based on a decreased amount of intake air that cancels an amount of fuel corresponding to the decreased amount of intake air, and (d) extracts, as an air-fuel ratio-increasing feedback adjustment coefficient, an air-fuel ratio feedback adjustment coefficient that is in such a range as to decrease the fuel concentration in the air-fuel mixture, and (e) adjusts an amount of fuel supplied to the internal combustion engine, based on the air-fuel ratio-decreasing feedback adjustment coefficient, the air-fuel ratio-increasing feedback adjustment coefficient, and the amount of intake air detected by the intake air amount detector.

5. An air-fuel ratio control apparatus for an internal combustion engine, comprising:

an air-fuel ratio detector that detects an air-fuel ratio of an air-fuel mixture supplied to the internal combustion engine;

an intake air amount detector that detects an amount of intake air taken into the internal combustion engine; and a control system that:

(a) determines an air-fuel ratio feedback adjustment coefficient, based on the air-fuel ratio detected by the air-fuel ratio detector, and (b) determines an amount of fuel supplied to the internal combustion engine, based on the amount of intake air detected by the intake air amount detector and the air-fuel ratio feedback adjustment coefficient, when the air-fuel ratio feedback adjustment coefficient is in such a range as to increase a fuel concentration in the air-fuel mixture, and (c) performs an intake air-increasing process, based on the air-fuel ratio feedback adjustment coefficient, and (d) determines the amount of fuel supplied to the internal combustion engine, based on the amount of intake air detected by the intake air amount detector and an air-fuel ratio-increasing feedback adjustment coefficient set so as to decrease in accordance with an increase in the amount of intake air, when the air-fuel ratio feedback adjustment coefficient is in such a range as to decrease the fuel concentration in the air-fuel mixture.

6. An air-fuel ratio control apparatus for an internal combustion engine according to claim 5, wherein the air-fuel ratio-increasing feedback adjustment coefficient is set to a value that cancels an increase in the amount of fuel supplied to the internal combustion engine that corresponds to the intake air-increasing process.

7. An air-fuel ratio control apparatus for an internal combustion engine, comprising:

an air-fuel ratio detector that detects an air-fuel ratio of an air-fuel mixture supplied to the internal combustion engine;

an intake air amount detector that detects an amount of intake air taken into the internal combustion engine; and a control system that:

(a) determines an air-fuel ratio feedback adjustment coefficient, based on the air-fuel ratio detected by the air-fuel ratio detector, and (b) determines an amount of fuel supplied to the internal combustion engine, based on the amount of intake air detected by the intake air amount detector and the air-fuel ratio feedback adjustment coefficient, when the air-fuel ratio feedback adjustment coefficient is in such a range as to decrease a fuel concentration in the air-fuel mixture, and (c) performs an intake air-decreasing process, based on the air-fuel ratio feedback adjustment coefficient, and (d) determines the amount of fuel supplied to the internal combustion engine, based on the amount of intake air detected by the intake air amount detector and an air-fuel ratio-decreasing feedback adjustment coefficient set so as to increase in accordance with a decrease in the amount of intake air, when the air-fuel ratio feedback adjustment coefficient is in such a range as to increase the fuel concentration in the air-fuel mixture.

8. An air-fuel ratio control apparatus for an internal combustion engine according to claim 7, wherein the air-fuel ratio-decreasing feedback adjustment coefficient is set to a value that cancels a decrease in the amount of fuel supplied to the internal combustion engine that corresponds to the intake air-decreasing process.

9. A method of controlling an air-fuel ratio of an internal combustion engine having an air-fuel ratio detector, an intake air amount adjuster, and a control system, comprising:

detecting the air-fuel mixture ratio;

increasing a fuel concentration in the air-fuel mixture by one of increasing an amount of fuel supplied or decreasing an amount of intake air, when the air-fuel ratio detected by the detector indicates a lower fuel concentration than a target air-fuel ratio; and decreasing the fuel concentration in the air-fuel mixture by one of increasing the amount of intake air or decreasing the amount of fuel supplied, when the air-fuel ratio detected by the detector indicates a higher fuel concentration than the target air-fuel ratio, wherein the steps of increasing the fuel concentration and of decreasing the fuel concentration either both physically increase or both physically decrease one of the fuel supplied and the amount of intake air.

10. A method of controlling an air-fuel ratio of an internal combustion engine according to claim 9, wherein the control system further determines an air-fuel ratio feedback adjustment coefficient that is reflected in a fuel concentration in the air-fuel mixture and the steps of increasing and decreasing the fuel concentration are performed based on the air-fuel ratio feedback adjustment coefficient.

11. A method of controlling an air-fuel ratio of an internal combustion engine according to claim 10, wherein the step of decreasing the fuel concentration includes increasing the air amount based on the air-fuel ratio feedback adjustment coefficient, the method further comprising:

determining and canceling an amount of fuel corresponding to the increased air amount.

12. A method of controlling an air-fuel ratio of an internal combustion engine according to claim 10, wherein the step of increasing the fuel concentration includes decreasing the air amount based on the air-fuel ratio feedback adjustment coefficient, the method further comprising:

determining and canceling an amount of fuel corresponding to the decreased air amount.

13. A method of controlling an air-fuel ratio of an internal combustion engine according to claim 10, wherein the air-fuel ratio feedback adjustment coefficient includes at least one of an air-fuel ratio-increasing feedback correction coefficient and an air-fuel ratio-decreasing feedback correction coefficient, and the method determines the amount of fuel supplied based on the air-fuel ratio-increasing feedback correction coefficient, and the amount of intake air.

14. A method of controlling an air-fuel ratio of an internal combustion engine having an air-fuel ratio detector, an intake air amount detector, an intake air amount adjuster, and a control system, comprising:

(a) determining an air-fuel ratio;

(b) detecting an intake air amount;

(c) determining an air-fuel ratio feedback adjustment coefficient based on the air-fuel ratio detected by the air-fuel ratio detector;

(d) determining the amount of fuel supplied to the internal combustion engine, based on the amount of intake air detected and the air-fuel ratio feedback adjustment coefficient is in such a range as to decrease the fuel concentration in the air-fuel mixture;

(e) performing an intake air-increasing process, based on the air-fuel ratio feedback adjustment coefficient; and (f) determining the amount of fuel supplied to the internal combustion engine, based on the amount of intake air detected and an air-fuel ratio-increasing feedback adjustment coefficient set so as to decrease in accordance with an increase in the amount of intake air, when the air-fuel ratio feedback adjustment coefficient is in such a range as to decrease the fuel concentration in the air-fuel mixture.

15. A method of controlling an air-fuel ratio of an internal combustion engine having an air-fuel ratio detector, an intake air amount detector, an intake air amount adjuster, and a control system, comprising:

(a) determining an air-fuel ratio;

(b) detecting an intake air amount;

(c) determining an air-fuel ratio feedback adjustment coefficient based on the air-fuel ratio detected by the air-fuel ratio detector;

(d) determining an amount of fuel supplied to the internal combustion engine, based on the amount of intake air detected and the air-fuel ratio feedback adjustment coefficient, when the air-fuel ratio feedback adjustment coefficient is in such a range as to decrease a fuel concentration in the air-fuel mixture;

(e) performing an intake air-decreasing process, based on the air-fuel ratio feedback adjustment coefficient; and (f) determining the amount of fuel supplied to the internal combustion engine, based on the amount of intake air detected and an air-fuel ratio-decreasing feedback adjustment coefficient set so as to increase in accordance with a decrease in the amount of intake air, when the air-fuel ratio feedback adjustment coefficient is in such a range as to increase the fuel concentration in the air-fuel mixture.

* * * * *